US008398802B2

(12) United States Patent
Kohler

(10) Patent No.: US 8,398,802 B2
(45) Date of Patent: Mar. 19, 2013

(54) METHOD FOR MOISTURE AND TEMPERATURE CONTROL IN CORRUGATING OPERATION

(75) Inventor: Herbert B. Kohler, Uniontown, OH (US)

(73) Assignee: Coater Services, Inc., Uniontown, OH (US)

( * ) Notice: Subject to any disclaimer, the term of this patent is extended or adjusted under 35 U.S.C. 154(b) by 220 days.

(21) Appl. No.: 12/692,085

(22) Filed: Jan. 22, 2010

(65) Prior Publication Data

US 2010/0181015 A1 Jul. 22, 2010

Related U.S. Application Data

(60) Provisional application No. 61/146,441, filed on Jan. 22, 2009, provisional application No. 61/185,043, filed on Jun. 8, 2009, provisional application No. 61/224,192, filed on Jul. 9, 2009.

(51) Int. Cl.
*B31F 1/28* (2006.01)

(52) U.S. Cl. ..... 156/205; 493/463

(58) Field of Classification Search ..... None
See application file for complete search history.

(56) References Cited

U.S. PATENT DOCUMENTS

| | | | |
|---|---|---|---|
| 1,199,508 | A | 9/1916 | Swift, Jr. |
| 1,848,583 | A | 3/1932 | Swift, Jr. |
| 1,981,338 | A | 11/1934 | Swift, Jr. |
| 2,398,844 | A | 4/1946 | Muggleton et al. |
| 2,622,558 | A | 12/1952 | Mikkelsen |
| 3,026,231 | A | 3/1962 | Chavannes |
| 3,046,935 | A | 7/1962 | Wilson |
| 3,077,222 | A | 2/1963 | Shanley |
| 3,178,494 | A | 4/1965 | Tisdale |
| 3,300,359 | A | 1/1967 | Nikkel |
| 3,303,814 | A | 2/1967 | Nitchie |
| 3,306,805 | A | 2/1967 | Klein et al. |
| 3,383,234 | A | 5/1968 | Nikkel |
| 3,479,240 | A | 11/1969 | Moser |
| 3,560,310 | A | 2/1971 | Bolton |
| 3,648,913 | A | 3/1972 | Ferara |
| 3,676,247 | A | 7/1972 | Morris et al. |
| 3,700,518 | A | 10/1972 | Ohmori |
| 3,773,587 | A | 11/1973 | Flewwelling |

(Continued)

FOREIGN PATENT DOCUMENTS

| | | |
|---|---|---|
| CA | 1072873 | 3/1980 |
| DE | 4018426 | 12/1991 |

(Continued)

OTHER PUBLICATIONS

International Search Report and Written Opinion issued May 18, 2010 in corresponding PCT Application Serial No. PCT/US10/21753.

(Continued)

*Primary Examiner* — Barbara J Musser
(74) *Attorney, Agent, or Firm* — Pearne & Gordon LLP

(57) ABSTRACT

A method of producing a corrugated product comprises the steps of providing at least one medium conditioning apparatus upstream of at least one of a corrugating labyrinth, single-facer, and/or double-backer. The moisture content in at least one of a web of medium material, first face-sheet, and/or second face-sheet is adjusted to be in the range of 6-9 wt. % moisture by applying a substantially continuous thin film of liquid thereto using the at least one medium conditioning apparatus. In one example, at least one heating arrangement is arranged downstream from the at least one medium conditioning apparatus to heat at least one of the web of medium material, first-face sheet, and/or second face-sheet.

36 Claims, 7 Drawing Sheets

U.S. PATENT DOCUMENTS

| | | | | | |
|---|---|---|---|---|---|
| 3,788,515 | A | | 1/1974 | Middleman | |
| 3,892,613 | A | * | 7/1975 | McDonald et al. | 156/210 |
| 3,966,518 | A | * | 6/1976 | Ferara et al. | 156/64 |
| 3,981,758 | A | | 9/1976 | Thayer et al. | |
| 4,086,116 | A | | 4/1978 | Yazaki et al. | |
| 4,104,107 | A | | 8/1978 | Christensen | |
| 4,134,781 | A | | 1/1979 | Carstens et al. | |
| 4,155,884 | A | | 5/1979 | Hughes | |
| 4,177,102 | A | | 12/1979 | Tokuno | |
| 4,267,008 | A | | 5/1981 | Owens | |
| 4,282,998 | A | | 8/1981 | Peekna | |
| 4,306,932 | A | | 12/1981 | Bradatsch et al. | |
| 4,316,428 | A | | 2/1982 | Flaum et al. | |
| 4,316,755 | A | | 2/1982 | Flaum et al. | |
| 4,338,154 | A | | 7/1982 | Berthelot et al. | |
| 4,344,379 | A | | 8/1982 | Roberts | |
| 4,351,264 | A | | 9/1982 | Flaum et al. | |
| 4,453,465 | A | | 6/1984 | Heller et al. | |
| 4,544,436 | A | | 10/1985 | Itoh et al. | |
| 4,569,864 | A | | 2/1986 | McIntyre | |
| 4,589,944 | A | | 5/1986 | Torti et al. | |
| 4,603,654 | A | | 8/1986 | Mori et al. | |
| 4,757,782 | A | | 7/1988 | Pullinen | |
| 4,764,236 | A | | 8/1988 | Nikkel | |
| 4,806,183 | A | | 2/1989 | Williams | |
| 4,841,317 | A | | 6/1989 | Westell | |
| 4,863,087 | A | | 9/1989 | Kohler | |
| 4,871,593 | A | | 10/1989 | McIntyre | |
| 4,879,949 | A | | 11/1989 | Vennike | |
| 4,886,563 | A | | 12/1989 | Bennett et al. | |
| 4,935,082 | A | | 6/1990 | Bennett et al. | |
| 4,991,787 | A | | 2/1991 | Berg | |
| 5,016,801 | A | | 5/1991 | Gilat et al. | |
| 5,037,665 | A | | 8/1991 | LaMantia et al. | |
| 5,048,453 | A | | 9/1991 | Eriksson | |
| 5,103,732 | A | | 4/1992 | Wells et al. | |
| 5,203,935 | A | | 4/1993 | May et al. | |
| 5,226,577 | A | | 7/1993 | Kohler | |
| 5,242,525 | A | | 9/1993 | Biagiotti | |
| 5,246,497 | A | | 9/1993 | Rantanen | |
| 5,275,657 | A | | 1/1994 | Duffy et al. | |
| 5,362,346 | A | | 11/1994 | Bullock, Sr. | |
| 5,503,547 | A | | 4/1996 | Funahashi et al. | |
| 5,508,083 | A | | 4/1996 | Chapman, Jr. | |
| 5,609,293 | A | * | 3/1997 | Wu et al. | 229/5.81 |
| 5,656,124 | A | | 8/1997 | Krayenhagen et al. | |
| 5,660,631 | A | | 8/1997 | Eriksson | |
| 5,783,006 | A | | 7/1998 | Klockenkemper et al. | |
| 5,785,802 | A | | 7/1998 | Seki et al. | |
| 6,051,068 | A | | 4/2000 | Kohl et al. | |
| 6,058,844 | A | | 5/2000 | Niemiec | |
| 6,068,701 | A | | 5/2000 | Kohler et al. | |
| 6,098,687 | A | | 8/2000 | Ishibuchi et al. | |
| 6,126,750 | A | | 10/2000 | Seiz et al. | |
| 6,136,417 | A | | 10/2000 | Ishibuchi et al. | |
| 6,143,113 | A | * | 11/2000 | Berube | 156/210 |
| 6,155,319 | A | | 12/2000 | Giugliano et al. | |
| 6,257,520 | B1 | | 7/2001 | Fujikura | |
| 6,364,247 | B1 | | 4/2002 | Polkinghorne | |
| 6,418,851 | B1 | | 7/2002 | Hartmann et al. | |
| 6,470,294 | B1 | | 10/2002 | Taylor | |
| 6,575,399 | B1 | | 6/2003 | Lamothe | |
| 6,595,465 | B2 | | 7/2003 | Lamothe | |
| 6,602,546 | B1 | | 8/2003 | Kohler | |
| 6,620,240 | B2 | | 9/2003 | Choi et al. | |
| 6,620,455 | B2 | | 9/2003 | Mensing et al. | |
| 6,635,111 | B1 | | 10/2003 | Holtmann et al. | |
| 6,692,602 | B1 | | 2/2004 | Mensing et al. | |
| 6,800,052 | B1 | | 10/2004 | Abe | |
| 7,267,153 | B2 | | 9/2007 | Kohler | |
| 7,595,086 | B2 | | 9/2009 | Kohler | |
| 2002/0149866 | A1 | | 10/2002 | Kato et al. | |
| 2003/0178524 | A1 | | 9/2003 | Newman et al. | |
| 2004/0241328 | A1 | | 12/2004 | Bradatsch et al. | |
| 2005/0194088 | A1 | | 9/2005 | Kohler | |
| 2006/0225830 | A1 | | 10/2006 | Kohler | |
| 2007/0261793 | A1 | | 11/2007 | Kohler | |

FOREIGN PATENT DOCUMENTS

| | | | |
|---|---|---|---|
| EP | 0037332 | | 10/1981 |
| EP | 1199151 | A2 | 4/2002 |
| EP | 1199152 | A2 | 4/2002 |
| EP | 0825017 | B1 | 7/2002 |
| GB | 1544634 | | 4/1979 |
| JP | S40-023188 | | 8/1965 |
| JP | S42-004916 | B | 2/1967 |
| JP | S56-160832 | | 11/1981 |
| JP | H01-228572 | | 9/1989 |
| JP | H10-034776 | | 2/1998 |
| JP | 2000-202930 | | 7/2000 |
| JP | 2001-063918 | | 3/2001 |
| JP | 2002-192637 | | 7/2002 |
| JP | 2005-193504 | | 7/2005 |

OTHER PUBLICATIONS

Shaw, N.W. et al., "Xitex—A revolution in board design and manufacture," Tappi Journal 1997 Corrugated Containers Conference Proceedings.

Daub, E. et al., "Gluing corrugating medium and linerboard together on the corrugator," Tappi Journal, pp. 171-178, Jun. 1990.

Eltex Elektrostatik GMBH, "Webmoister 70XR" Presentation.

Inoue, M. et al., "Kinetics of gelatinization of cornstarch adhesive," J. Applied Polymer Sci., vol. 31, pp. 2779-2789, 1986.

Institute of Paper Chemistry, "Development of a Cold Corrugating Process," Contract No. DE-AC02-79CS40211, Appleton, WI, Dec. 15, 1981.

Janes, R.L., "A Study of Adhesion in the Cellulose-Starch-Cellulose System," Institute of Paper Chemistry, Appleton, WI, Jun. 1968.

Kohler, H.B., "Cold Corrugating" Presentation.

Kroeschell, W.O., "Bonding on the corrugator," Tappi Journal, pp. 69-74, Feb. 1990.

Ononokpono, O.E. et al., "The influence of binder film thickness on the mechanical properties of binder films in tension," J. Pharm Pharmacol, pp. 126-128, Feb. 1988.

Printco Industries, LLC, "Chambered Reverse Angle Doctor Blade System," retrieved from www.printco-industries.com on Sep. 25, 2009.

Sprague, C.H., "Development of a Cold Corrugating Process Final Report," Institute of Paper Chemistry, Appleton, WI, May 1985.

Whitsitt, W.J. et al., "High Speed Runnability and Bonding: Effects of Medium and Corrugator Conditions on Board Quality," Institute of Paper Chemistry, Appleton, WI, May 1, 1989.

Page from a brochure for the Marquip Pyrobond Singlefacer.

International Search Report, Written Opinion and International Preliminary Report on Patentability from PCT Application Serial No. PCT/US2005/001925, Apr. 2007.

International Search Report, Written Opinion and International Preliminary Report on Patentability from PCT Application Serial No. PCT/US2006/013578, Oct. 2007.

International Search Report, Written Opinion and International Preliminary Report on Patentability from PCT Application Serial No. PCT/US2006/035474, Apr. 2008.

International Search Report and Written Opinion from PCT Application Serial No. PCT/US2008/067519, Oct. 2008.

International Search Report and Written Opinion from PCT Application Serial No. PCT/US2009/037959, Aug. 2009.

European Search Report, from European Application No. 03100620.8, Oct. 2003.

Prosecution history for U.S. Appl. No. 11/279,347.

Prosecution history for U.S. Appl. No. 11/781,563.

Notice of Rejection issued Sep. 29, 2009 in Japanese Patent Application No. 2007-501779.

* cited by examiner

METHOD FOR MOISTURE AND TEMPERATURE CONTROL IN CORRUGATING OPERATION

CROSS-REFERENCE TO RELATED APPLICATIONS

This application claims the benefit of U.S. Provisional Application Nos. 61/146,441, filed Jan. 22, 2009; 61/185,043, filed Jun. 8, 2009; and 61/224,192, filed Jul. 9, 2009, the entire disclosures of which are hereby incorporated herein by reference.

FIELD OF THE INVENTION

The present invention relates generally to the production of corrugated cardboard, and more particularly, to moisture and temperature control during the production of corrugated cardboard.

BACKGROUND OF THE INVENTION

The present invention generally relates to the production of corrugated cardboard, and more particularly, to a novel and improved apparatus and method for to controlling moisture and temperature during the production of corrugated cardboard.

Typically, corrugated cardboard is formed by producing a corrugated sheet which is initially bonded along one side to a single face. Adhesive is then applied to the crests of the flutes remote from the single face by an applicator roll of a glue machine. Thereafter, a second face is applied to the adhesive on the flutes to produce a composite structure in which corrugations extend between and are bonded to spaced-apart faces. In some instances, multiple-layer cardboard is produced in which more than one corrugated sheet is adhesively attached to additional faces so that, for example, a central flat face is bonded to a corrugated sheet on each side thereof, and outer flat faces are bonded to the sides of the two corrugated sheets remote from the central face.

The process of making corrugated board out of 3 or more running webs of paper is more than 100 years old. Typically, two webs of paper are heated, one of the webs is formed into a corrugated or sinusoidal shape by a pair of forming or corrugating rolls, a water based adhesive is applied to the tips of the flutes of the resulting corrugated paper and the other paper is brought into contact with the adhesive-applied flute tips of the corrugated paper under pressure in order to create what is called single face. Next, adhesive is applied to the tips of flutes on the other side of the corrugated paper and a third piece of heated paper is brought into contact under pressure in order to make a rigid three-layer structure having the corrugated paper in between the other two paper sheets. This process can be repeated and additional single face webs can be combined to make multi-pli constructions having more than three layers, with alternating corrugated and flat paper sheets.

In most corrugating plants the adhesive is starch-based and requires heat and pressure as part of the chemical reaction to gelatinize the starch into a film, and then water must be removed from the adhesive by a further application of heat in order to fully cure the adhesive. Being composed of all or in part cellulose fibers, the properties of the types of paper used in the manufacture of corrugated board are greatly affected by changes in temperature and moisture content. The process itself requires that the papers be maintained within relatively narrow bands of both temperature and moisture in order to achieve maximum strength of the finished papers. For example, the paper that is formed sinusoidally undergoes significant stress during forming and benefits from sufficient moisture content in order to be formed correctly.

Further, the dimensional stability (e.g., flatness) of the finished product can be dependent on the moisture balance between the two outside sheets of paper (referred to as liners) that are bonded to the sinusoidally shaped (corrugated) paper web. After combination into laminate sheets of paperboard, the individual sheets of paper lose or gain moisture to or from each other and the surrounding atmosphere until an equilibrium condition is reached. In order to achieve an optimum flatness, the individual sheets of paper should gain or lose as little moisture as possible during the process and should be as close to their equilibrium moisture as possible upon exiting the corrugator. This way post warp can be reduced, such as minimized. If the corrugator crew makes the finished product come out flat on the corrugator, the board should generally stay flat for subsequent processing.

One problem that occurs is that most methods available to heat paper to its desired temperature for bonding on the corrugator simultaneously remove water as the paper is being heated. One way to combat the resulting water removal is to use an infusion system, such as one that tries to inject steam under the web through the surface of the heating device to reduce this moisture loss. This device is very speed dependant and difficult to control. Additionally, since the typical corrugator continually changes speeds in a matter of seconds, and the current methods of heating papers sometimes respond in minutes (e.g., 20 minutes or other timeframe), it becomes difficult to achieve specific temperature and moisture contents independently of one another.

Another problem that occurs on the typical corrugator concerns the methods available to adjust heat. Typically steam heated drying cylinders are used to preheat paper. The drying cylinders have movable rolls that can adjust the angle of wrap on the drying cylinder over as much as a 15 to 1 range of maximum to minimum angle of wrap, for example with a maximum angle of wrap around the cylinder being 300° and a minimum angle of wrap being 20°. This provides the ability to adjust the heat applied to the paper by the same 15 to 1 range. In the final section (e.g., the doublebacker), it is common to adjust the heat by adding or subtracting loading shoe or contact roll pressure to press the combined board against the heat source. The typical corrugator doublebacker can have the heat transferred to the paper adjusted by less than the 15 to 1 range available with wrap roll controls on cylinders. Unfortunately, the typical corrugator speed range is much wider than the described 15 to 1 range. A typical corrugator is designed with enough heat transfer capacity to heat the papers being processed to at least 125 degrees Celsius at the maximum speed. Temperatures of 150 degrees Celsius are not uncommon.

The typical corrugator operates over a speed range of 5 meters per minute on startup up to about 300 meters per minute, or even more. This is a speed range of 60 to 1. Some high speed corrugators are designed to operate to 450 meters per minute which is a speed range of 90 to 1. This means that at lower speeds the best the corrugator can do is transfer 4 to 6 times (60/15=4, 90/15=6) more heat to the paper than desirable. Additionally, the basis weight of paper commonly used is about 100-300 grams per square meter (e.g., a 3 to 1 range). This provides a real-world heat transfer range of at least a 180 to 1 (e.g., 60×3=180). Conventional corrugators cannot adjust precisely or quickly enough to cover such a range. As a result, it is not uncommon for the moisture in the paper to fall to 2% or less if overheated. This results in significant waste whenever the corrugator is restarted.

Various methods of adding moisture back to the papers during the process are known. These include spraying steam on the web as it passes by (which also partially heats the paper), and spraying water on the paper in order to adjust moisture content. Various mechanical devices are available to change the length of contact between the corrugator heat sources (usually steam heated drums) so that as speed falls the contact time between paper and heat source can be kept relatively more constant.

The moisture addition devices currently in use in the paper industry apply moisture to the paper after it has been heated. This is too late. Paper is damaged irreparably by heat. As water is removed from paper fibers, they become weaker and more susceptible to brittle fractures. This internal water comes out of the cell walls of the fiber. This process is not reversible by re-moisturizing after the damage is done. Water reabsorbed into the paper by re-moisturizing is external water that remains outside the cell walls where it can damage the attachment between paper fibers and make the board appear wet.

Generally, whenever paper's moisture increases, it swells; whenever its moisture is reduced, it shrinks. Interestingly, each time paper is wetted and dried, it can shrink back smaller than it was before. As with heat, paper properties are irreparably damaged by moisture. To add perspective regarding the drying conditions discussed above, it should be noted that on a paper machine final moistures below about 5% represent severe cases of "over-drying" that are known to damage paper properties. For this reason, the paper temperature conditions of 125° C. and higher used in the corrugating industry almost certainly result in further reductions in paper properties.

BRIEF SUMMARY OF THE INVENTION

In accordance with one aspect of the present invention, a method of producing a corrugated product is provided, comprising the steps of providing a pair of corrugating rollers that cooperate to define, at a nip therebetween, a corrugating labyrinth between respective and interlocking pluralities of corrugating teeth provided on said corrugating rollers and providing a medium conditioning apparatus upstream of said corrugating rollers. The method further includes the steps of providing a heating arrangement downstream of said medium conditioning apparatus and upstream of said corrugating labyrinth, and feeding a web of medium material along a web pathway through said medium conditioning apparatus, through said heating arrangement, and subsequently through said corrugating labyrinth. The method further includes the steps of adjusting the moisture content in said web of medium material to be in the range of 6-9 wt. % moisture, prior to said web entering said corrugating labyrinth, by applying a substantially continuous thin film of liquid to the web of medium material using said medium conditioning apparatus, and heating said web of medium material via transfer of thermal energy from said heating arrangement to a temperature less than or equal to about 100° Celsius.

In accordance with another aspect of the present invention, a method of producing a corrugated product is provided, comprising the step of providing a single-facer that is adapted to couple a corrugated web of medium material to a first face-sheet to form a single-faced web. The method further comprises the step of adjusting the moisture content in said first face-sheet, upstream of where said first face-sheet is coupled to said corrugated web, to be in the range of 6-9 wt. % moisture by applying a substantially continuous thin film of liquid to the first face-sheet. The method further comprises the step of coupling said first face-sheet to said corrugated web to produce said single-faced web.

In accordance with another aspect of the present invention, a method of producing a corrugated product is provided, comprising the steps of providing a single-facer that is adapted to couple a corrugated web of medium material to a first face-sheet to form a single-faced web, and providing a double-backer downstream of said single-facer that is adapted to couple said single-faced web to a second face-sheet to form a corrugated board. The method further comprises the step of adjusting the moisture content in said second face-sheet to be in the range of 6-9 wt. % moisture, upstream of where said second face-sheet is coupled to said single-faced web, by applying a substantially continuous thin film of liquid to the second face-sheet. The method further comprises the step of coupling said second face-sheet to said single-faced web to produce said corrugated board.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
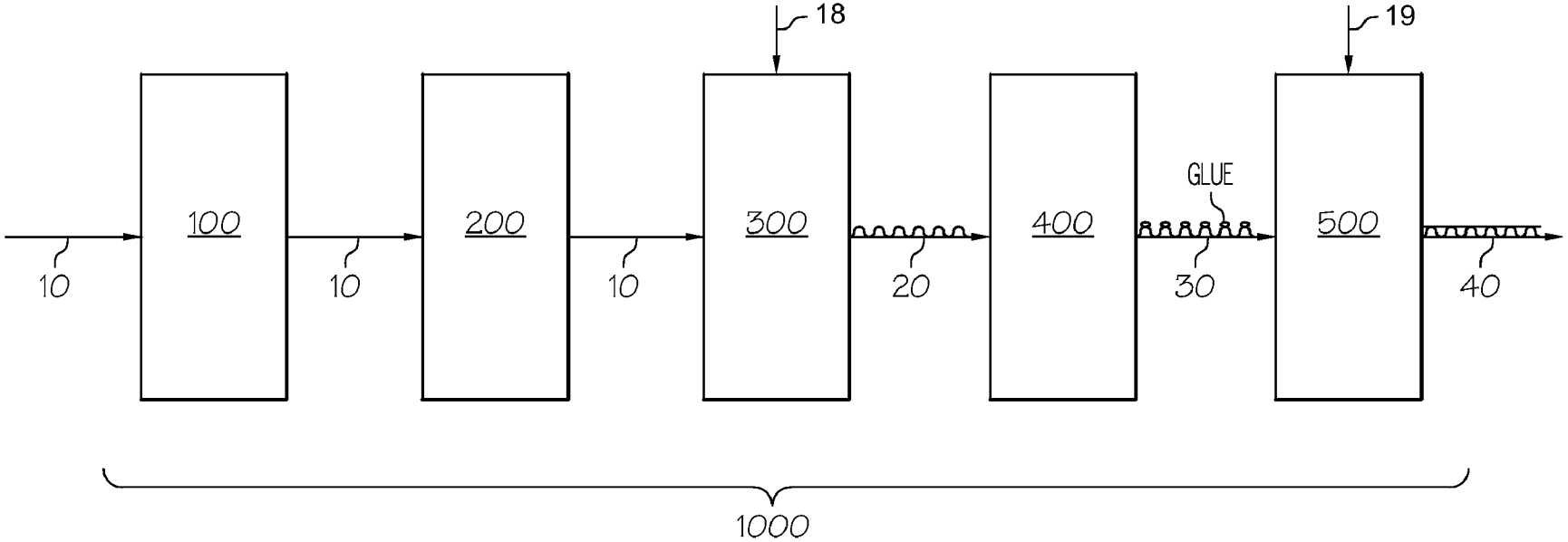
FIG. 1 is a top level schematic block diagram illustrating the process steps and associated equipment for a corrugating method.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

As used herein, the terms "glue" and "adhesive" are used interchangeably, and refer to the adhesive that is applied to the various elements (e.g., sheets) that form a corrugated board, such as to the flute crests of a corrugated sheet. Also as used herein, the term "web" refers to the various elements (e.g., sheets) traveling through the corrugated board manufacturing machinery, and particularly as it travels past on or more rollers, such as for applying liquids, heat, adhesives, etc. thereto as will be further described.

The present application provides various example methods and apparatus to decouple the heating of the papers from the control of moisture content, and to add or subtract sacrificial water fast enough that the desired paper moisture content and temperature can be maintained generally independent of the constantly fluctuating speed of the corrugator. As will be described, it can be desirable to maintain the internal moisture content of the paper fibers as close as possible to final shipping moisture in order to insure dimensional stability. It can also be further desirable to allow the automation of the process by adding appropriate sensors and closed loop feedback controls so that the corrugator can respond to incoming raw material variations in moisture and temperature.

A block diagram of an example corrugating apparatus 1000 is shown schematically in FIG. 1. In the illustrated embodiment, the corrugating apparatus includes a medium conditioning apparatus 100, a web heating arrangement 200, a single-facer 300, a glue machine 400 and a double-backer 500. These components are arranged in the recited order relative to one example machine direction of a web of medium material 10 as it travels along a machine path through the corrugating apparatus 1000 in order to produce a finished corrugated product 40 on exiting the double-backer 500 as illustrated schematically in FIG. 1. As will become apparent, the medium material 10 will become the corrugated web to which the first and second face-sheet webs 18 and 19 will be adhered on opposite sides to produce the finished corrugated board 40. An exemplary embodiment of the above elements of the corrugating apparatus 1000 will now be described. Still, it is to be understood that some of the described elements may be optionally omitted, and/or other elements may be added as desired, and/or the order of the various elements/steps may be altered.

One way to provide generally independent control of moisture content is to make use of the way that paper gives off moisture when heated. For example, as paper is heated, it can be beneficial to provide the paper with enough water to maintain the desired moisture content and to limit the temperature rise during heating.

A brief explanation of drying fundamentals will be provided. Commonly used drying systems for paper function by applying heat energy (thermal energy) to assist in removing the excess water from the applied adhesive. The mass transfer (movement of the water) from the web and the adhesive takes place simultaneously with the heat transfer. Heat transfer is thermal energy in transition due to a temperature difference. During the drying process the driving force for heat transfer is the temperature difference. The three basic mechanisms of heat transfer can be identified as follows: conduction; convection; and radiation. Conduction occurs via transmission of thermal energy between molecules or atoms of a solid, liquid or gas, or between different solids, liquids, or gasses in stationary physical contact with one another. This is a primary method of drying on corrugators. Heat is transmitted to the paper through direct contact with various heat sources, such as steam-heated rolls, preheaters and the hot plates in the doublebacker. Convection is the process of heat transfer between a surface and a liquid or gas in motion. On the corrugator heat is lost from the paper to the air by convection. Convection is the primary mode of transferring heat (transmitted by heated vapor) to the upper glue line(s) in the manufacture of double wall or triple wall corrugated board. Radiation is the transfer of heat in the form of electromagnetic waves. Infrared drying would be an example. This mode is seldom used in corrugating but could be applied as the heating source if desired.

Vaporization of the excess moisture from the paper and the glue is a form of mass transfer as it is transported out of the paper into the surrounding air. Mass transfer (or evaporation) is a function of the thermodynamic equilibrium between liquid water in the board (including the water in the starch slurry) and the moisture vapor in the board and the surrounding air. For evaporation, the higher the temperature and the lower the humidity in the surrounding atmosphere (compared to water's vapor pressure at the ambient temperature), the more rapid the mass transfer or evaporation out of the board. The equilibrium vapor pressure of water at the ambient temperature supplies the driving force for vaporization to produce a saturated vapor in the board. Additional heat will produce superheated steam in the board, above the saturation temperature. Operating in the steady-state evaporation regime mentioned below (where the presence of liquid water is maintained) can ensure that the temperature in the water in the board does not exceed the boiling point temperature of water at ambient pressure (100° C.), because energy input to the system will go to latent heat of vaporization to convert saturated liquid to saturated vapor, before superheating any saturated steam present.

The drying profile for corrugated board has three distinct phases. These phases will become important considerations when selecting a drying rate profile to increase, such as maximize, glue efficiency. The three phases are as follows: pre-heat; steady state evaporation; and falling rate. Pre-heat involves the heating of the paper, starch molecules and water to a temperature where the web temperature, air temperature, humidity and evaporation rate are in balance. Steady State Evaporation occurs where most of the energy being input is used to evaporate water, the starch and paper temperatures remain fairly constant. This phase of the drying rate profile is important in conjunction with the process disclosed herein. Falling Rate occurs where the evaporation rate begins to decline due to the lack of remaining moisture in the starch and the base sheet. Once the free water has been evaporated and the remaining water is widely dispersed, it becomes necessary to increase the web temperature to break the remaining water loose.

For the types of paper usually used in the manufacture of corrugated board we find that desired moisture contents of both the incoming papers and the finished board fall inside a band between 5 and 10% moisture. Most preferably, the moisture content is between approximately 6 and 8% moisture. For virtually all papers, the steady state zone of evaporation should maintain moisture contents between 5 and 10%. Additionally, a desirable temperature for bonding paper in the corrugated process (approximately 85-90 degrees Celsius) happens to be the temperature the paper achieves in the steady state evaporation zone. This means if we can heat the paper to the steady state evaporation temperature, we can adjust its moisture content while avoiding over- or under-shooting on temperature.

Water migration during heating and the pathways that water takes exiting the board can be quite difficult to understand. In an idealized process, the paper conditioned by the method and apparatus of this application, which contains 6-9% moisture, comes into contact with the heated surface of the preheater. The moisture present nearest the heat source will be heated and converted into steam, which moves away from the heated surface. As it moves away from the heat source, the steam almost immediately loses some heat to its surroundings and is converted back into liquid water. This makes the immediate paper fibers next to the heat source drier. The dry area thus created will attract moisture still present in the adjacent fibers. As this moisture migrates into the dry area it will also be evaporated and escapes away from the heat driven by the vapor pressure. This creates a flow of water towards the hot surface and steam/water vapor away from the hot surface until all the moisture has been evaporated. With this type of heating, by the time the paper reaches the desired temperature for corrugating, it is generally left much drier than desired for an optimum bond. The loss of internal water from the paper fibers also causes a loss in paper properties by reducing the strength of the individual fibers.

In short, using a medium conditioning apparatus, such as an applicator roll-based metering system, to apply a liquid film onto at least one flat paper at a location upstream of where the paper is either corrugated and/or applied to another sheet (i.e., upstream of the single-facer or double-backer), and especially with the subsequent application of heat to the paper, can provide amazing and unexpected results relating to the ability to control moisture and temperature of the paper material within the corrugator machinery. For example, where a corrugated board is formed of three layers (i.e., a bottom layer, a corrugated medium layer, and a top layer), at least one, such as three, medium conditioning apparatus can be utilized.

Figure 2:
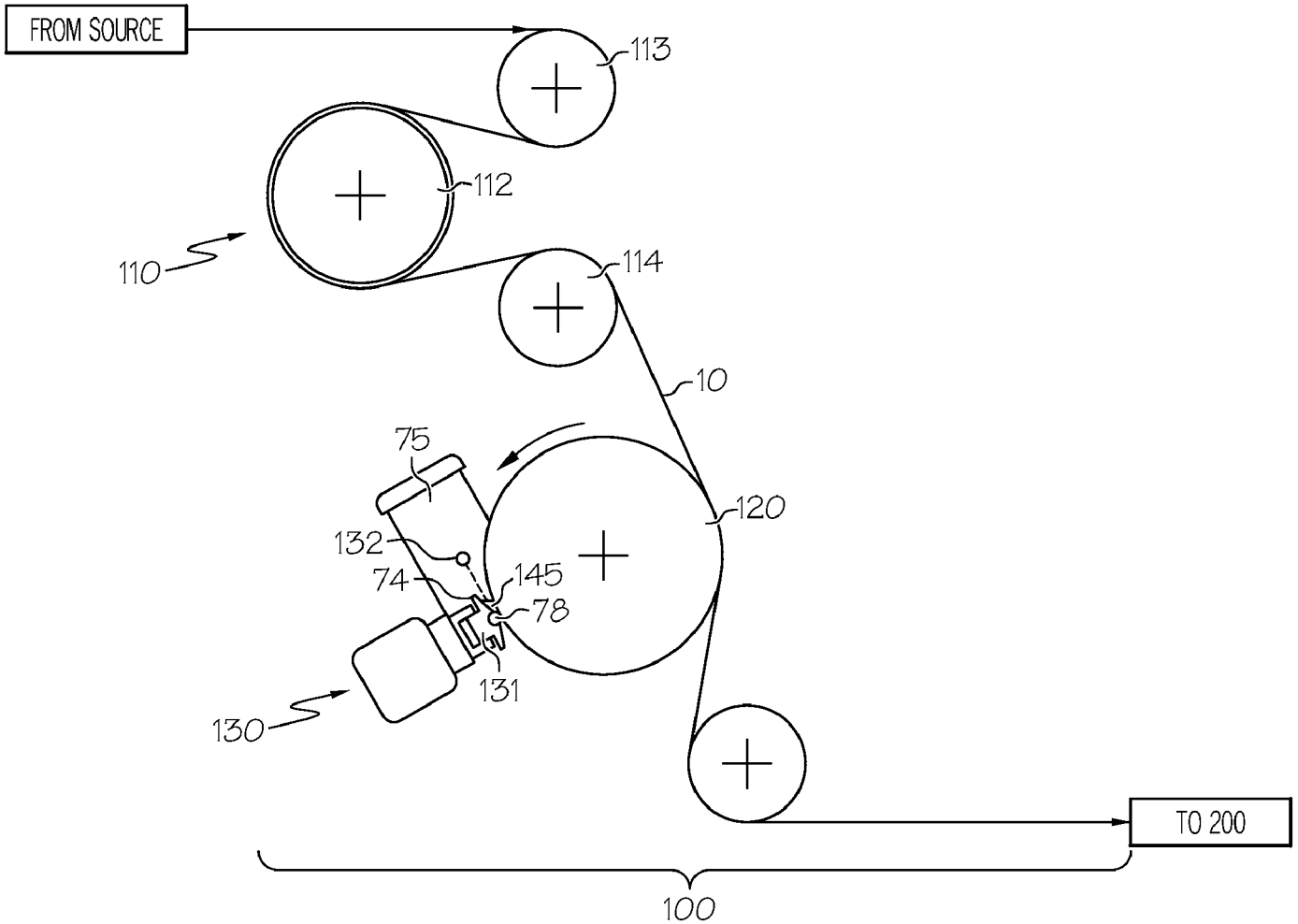
FIG. 2 is a schematic diagram of a medium conditioning apparatus that can be used in a corrugating method.

The medium conditioning apparatus 100 of FIG. 2 is provided to raise the moisture content of the medium material 10 prior to being fed to the single-facer 300 where it will be formed (corrugated) into a corrugated web as further explained below. Conventional medium material 10 for producing the corrugated web is supplied having an extant moisture content that can be as low as 4-5 percent by weight ("wt. %"). In the medium conditioning apparatus, the moisture content of the medium material 10 is raised to about 6-9 wt. %. A moisture content in this range provides the medium material 10 with a greater degree of elasticity or flexibility so that as the material 10 is drawn through the corrugating labyrinth 305 (explained more fully below) it is better able to stretch and withstand the tensile forces experienced therein to avoid fracturing. In addition, an elevated moisture content in the range of 7-8 or 7-9 wt. % lowers the coefficient of friction between the medium material 10 and the corrugating rollers 310, 311 so that the material 10 slides more easily against the opposing teeth of these rolls 310, 311 as it is drawn through the corrugating labyrinth 305. This aids in reducing, such as minimizing or preventing, fracturing due to tensile overstressing of the medium as it is drawn through the corrugating labyrinth 305 where it is formed into a corrugated web.

A web of medium material 10 is fed into the medium conditioning apparatus 100 from a source of such material such as a roll as is known in the art. On entering the medium conditioning apparatus 100, the material 10 can optionally be fed first through a pretensioning mechanism 110 and then past a moisture application roller 120 where moisture is added to the medium material 10 to adjust its moisture content in the desired range prior to exiting the medium conditioning apparatus 100. Still, in other examples, the material 10 can be fed directly past the moisture application roller 120.

The pretensioning mechanism 110 adjusts the tension of the medium material 10 as it contacts the moisture application roller 120 so the medium material 10 is pressed against that roller 120 with an appropriate amount of force to ensure adequate penetration into the medium material 10 of moisture supplied by the roller 120. At higher web speeds it is sometimes required or desirable to add an additional pressure roller (not shown) to lightly press the web against the moisture application roller. The amount of moisture on the surface of roller 120 is very precisely controlled in order to achieve the desired increase in moisture content for the passing medium material (e.g. from 4-5 wt. % to about 6-9 wt. %). By regulating the precise amount of moisture on the roller 120 surface and the tension of the medium material 10 as it is conveyed against that roller, an appropriate amount of additional moisture can be imparted to the passing medium material to adjust its moisture content in the appropriate range. Adjustment structure can be provided to regulate the amount of moisture in the cross-machine direction (longitudinal direction of the roller 120) to compensate for cross web variations in moisture created during the manufacture of the medium material 10, thus bringing cross-web moisture variation to a lower average value.

In the illustrated embodiment, the pretensioning mechanism 110 includes a suction roller 112 that is flanked on either side by cooperating idler rollers 113 and 114 such that the medium material 10 follows a substantially U-shaped pathway around the suction roller 112. It is preferred that the U-shaped pathway around the suction roller 112 is such that the medium material is in contact with that roller 112 around at least 50 percent of its circumference, which would result in a true "U" shape. Alternatively, and as illustrated in FIG. 2, the medium material can contact the suction roller 112 around greater than 50, e.g. at least 55, percent of its circumference resulting in the approaching and emerging portions of the web pathway relative (and tangent) to the suction roller 112 defining convergent planes as seen in the figure. Suction rollers are well known in the art and can operate by drawing the passing web against their circumferential surface through a vacuum or negative pressure produced, e.g., via a vacuum pump (not shown). The circumferential surface of the suction roller 112 is provided with a plurality of small openings or holes in order that such negative pressure will draw the medium material 10 against its circumferential surface. The force with which a passing web is drawn against the surface of a suction roller is proportional to the surface area of contact, which is the reason the idler rollers 113 and 114 are positioned to ensure contact over at least 50 percent of the suction roller's surface area.

In operation, the suction roller 112 is rotated in the same direction as the web of medium material 10 traveling over its surface, but at a slower surface linear speed than the linear speed the web 10 is traveling. In addition, the surface linear speed of the suction roller 112 is slightly slower than that of the downstream suction roller 212, which is described below. The relative difference in the surface linear speeds of these two suction rollers 112 and 212 causes an elongation of the medium material 10 between the two idler rollers 113 and 114, thereby tensioning the downstream portion of the medium material 10 on approach of the moisture application roller 120. By adjusting the radial velocity of the suction roller 112, the downstream tension in the medium material 10 can be adjusted to select an appropriate tension for producing the desired moisture content, as well as penetration of moisture, in the medium material on contacting the moisture application roller 120. One or a set of load cells (not shown) provided downstream of the suction roller 112 can be used to provide feedback control as will be understood by those of ordinary skill in the art to trim the radial velocity of the suction roller 112 to achieve a constant tension. It is recognized that an iterative process of trial and error may be desirable to discover optimal values for the surface linear speed of the moisture application roller 120, the tension in the web 10, the moisture layer thickness on the circumferential surface of the roller 120 (described below), as well as other factors to achieve a water content in the web 10 within the desired 6-9 wt. % range. For example, these and other variables may be adjusted taking into account the initial moisture content in the medium material web 10, which may vary from batch to batch, based on ambient weather conditions, production conditions, etc.

Moisture is applied to the circumferential surface of the moisture application roller 120 using a first thin film metering device 130. This device 130 is illustrated schematically in FIG. 2 and is useful to coat a very precisely metered thin film or layer 84 (FIG. 2*c*) of liquid onto the surface of the roller 120 from a reservoir. The thin film of liquid can include any or all of water, adhesives, additives, and/or other liquids, which may have various solids or gasses therein. For clarity, the following example will be described with reference to the liquid being water, though it is to be understood that various other liquids can also be used. The first thin film metering device 130 can be as described in U.S. Pats. Nos. 6,068,701 and 6,602,546, the contents of which are incorporated herein by reference in their entirety.

Optionally, and as disclosed in the '546 patent noted above, the metering device 130 can include a frame member and a plurality of metering rod assemblies adapted to apply varying thin film thicknesses that may be useful, e.g., where it is desirable to be able to quickly change the thickness of the water film on the surface of the roller 120. See FIG. 3 of the '546 patent incorporated above, and particularly the "isobar assembly 50" and associated description. While the fluid metering method may be similar, one difference in the shown example is that we are now applying the liquid to a continuous flat web, and not discontinuously only to flute tips.

Figure 2A:
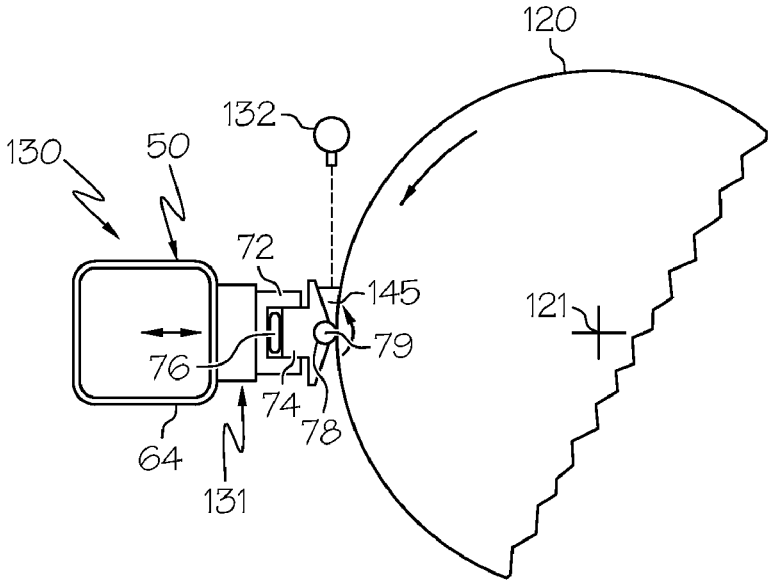
FIG. 2*a* is a close-up view of the thin film metering device in the medium conditioning apparatus of FIG. 2.

As best seen in FIG. 2*a*, the metering device 130 preferably includes a metering rod assembly 131 adapted to produce a precisely metered thin film of water onto the surface of the roller 120. The metering rod assembly 131 includes a channel member 72, a holder 74, a tubular pressure-tight bladder 76, and a metering rod 78. The channel member 72 is secured to the side of a frame member 64 and forms a longitudinally extending channel. The holder 74 has a projection on an inner side and a groove on an outer side. The projection is sized and shaped to extend into the channel so that the holder 74 is moveable toward and away from the frame member 64 within the channel member 72. The groove is sized and shaped for receiving the metering rod 78 so that the metering rod 78 is mounted in and supported by the holder 74.

The bladder 76 is positioned between the holder 74 and the channel member 72 within the channel of the member 72. Fluid pressure, preferably air pressure, is applied to the bladder 76 of the metering rod assembly. The fluid pressure within the bladder 76 produces a force urging the holder 74 and the associated metering rod 78 toward the outer circumferential surface of the moisture application roller 120. The force produced by the bladder 76 is uniform along the entire length of the metering rod 78.

The metering rod 78 is supported such that the metering rod 78 is not deflected up or down with respect to the roller 120 as a result of the hydraulic pressure; i.e. the metering rod 78 is urged toward the roller 120 such that the metering rod axis 79 and the applicator axis 121 of the moisture application roller 120 remain substantially parallel and in the same plane during operation. Therefore, the metering rod 78 is positioned to produce a uniform thickness or coating of water on the outer circumferential surface of the moisture application roller 120 along its entire length.

Figure 2B:
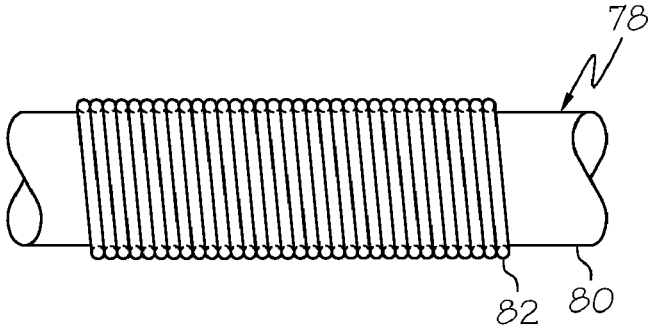
FIGS. 2*b*-2*d* illustrate various features and/or alternatives of metering rods useful in the thin film metering device.
Figure 2C:
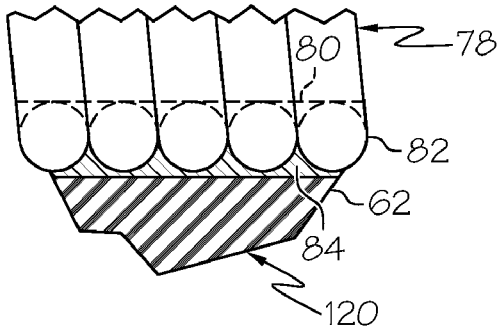

As best shown in FIGS. 2*b* and 2*c*, the metering rod 78 preferably includes a cylindrical rod 80 and spiral wound wire 82 thereon. The rod 80 extends the length of the moisture application roller 120 and has a uniform diameter such as, for example about ⅝ of an inch. The wire 82 has a relatively small diameter such as, for example, of about 0.06 inches. The wire 82 is tightly spiral wound around the rod 80 in abutting contact along the length of the rod 80 to provide an outer surface, best illustrated in FIG. 2*c*, that forms small concave cavities 84 between adjacent windings of the wire 82. When a spiral-wound wire 82 is used to provide the cavities 84, those cavities take the form of a continuous groove that extends helically around the rod 80. Utilizing rods with different groove open areas, the medium conditioning apparatus 100 can provide various fluid thicknesses, such between 5 microns and 50 microns (essentially a 10 to 1 range). Thus, the medium conditioning apparatus 100 can coat the paper web with an adjustable, continuous film of liquid, such as water or other liquid.

As best shown in FIG. 2*a*, the metering rod 78 is mounted in and supported by the outer groove of holder 74 for rotation therein about its central axis 79. The metering rod 78 is operatively coupled to and rotated by a motor 75, illustrated schematically in FIG. 2. In operation, the metering rod 78 is rotated at a relatively high speed in the same angular direction as the rotation of the moisture application roller 120 (counterclockwise in FIG. 2*c*).

Figure 2D:
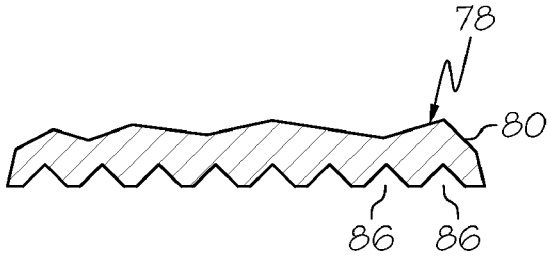

As best shown in FIG. 2*d*, the metering rod 78 can alternatively be a solid rod that has been machined to provide a grooved outer surface rather than having wire wound thereon. The machined outer surface preferably has inwardly extending cavities or grooves 86 that function similarly to the concave cavities 84 formed by the wire 82. The illustrated grooves 86 are axially spaced along the length of the metering rod 78 to provide narrow flat sections between the grooves 86. This embodiment of the metering rod 78 tends to remove a greater amount of film material and is typically used in applications where very thin coatings of adhesive are desired or required (as in the single-facer 300 and the glue machine 400 described below). Additional details regarding the preferred thin film metering device can be found through reference to the aforementioned U.S. patents.

Returning to FIGS. 2 and 2*a*, in operation the moisture application roller 120 is rotated such that at the point where it contacts the web of medium material 10 its surface is traveling in an opposite direction relative to the direction of travel of that web 10. This, coupled with the tension in the web, aids in driving moisture from the roller 120 into the passing medium material web 10 to provide substantially uniform moisture penetration. Water is fed from a reservoir (not shown) into a pond 145 via a spray bar 132 located above the metering rod 78 (most clearly seen in FIG. 2*a*). The pond 145 is preferably created by loading the metering rod 78 uniformly against the circumferential surface of roller 120 using a flexible rod holder 74 that pushes the metering rod 78 against the roller 120, and filling the resultantly defined cavity with water from the spray bar 132. The metering rod 78 acts as a dam to prevent the water in the pond 145 from escaping uncontrollably around the surface of the moisture application roller 120. End dams (not shown) also are provided and prevent the water from escaping around the edges of the metering rod 78 and roller 120. The grooves 84/86 in the rod 78 volumetrically meter the amount of water deposited onto the circumferential surface of the roller 120 as that surface rotates past the metering rod 78 by restricting the amount of water than can pass through the grooves from the pond 145. This effect results in a very thin film of moisture on the surface of the roller 120 with negligible cross roller variation.

By appropriate regulation of 1) the tension of the medium material web past the moisture application roller 120, 2) the rotational speed of that roller 120, and 3) the thickness of the moisture film provided on the surface of that roller 120 using the metering device 130, very precise quantities of moisture can be added to the medium material 10 in order to raise or adjust its moisture content within the desired range, most preferably about 7-9 wt. % or 7-8 wt. %. A moisture sensor (e.g., 250, 255) can be mounted downstream of the moisture application roller 120 and used in a feedback control loop (e.g., with control system 260) as known in the art to maintain a downstream moisture set point. Alternatively, such a sensor also could be mounted upstream in a feedforward control loop so the system can anticipate changes in incoming medium material 10 moisture. In response to signals from these sensor (s), a control system can adjust the speed of the moisture application roller 120 or the web tension to adjust the amount of moisture transferred from the roller 120 to the passing web of medium material 10.

Optionally, the medium conditioning apparatus 100 can be provided without (i.e. excluding) the pretensioning mechanism 110, particularly if the web tension upstream (supplied by the source of medium material) is also suitable for operation of the moisture application roller 120 to impart adequate moisture to the web 10. It is believed this will be the case in many if not most practical applications, so the pretensioning mechanism 110 should be considered an optional component and may be omitted.

Figure 3:
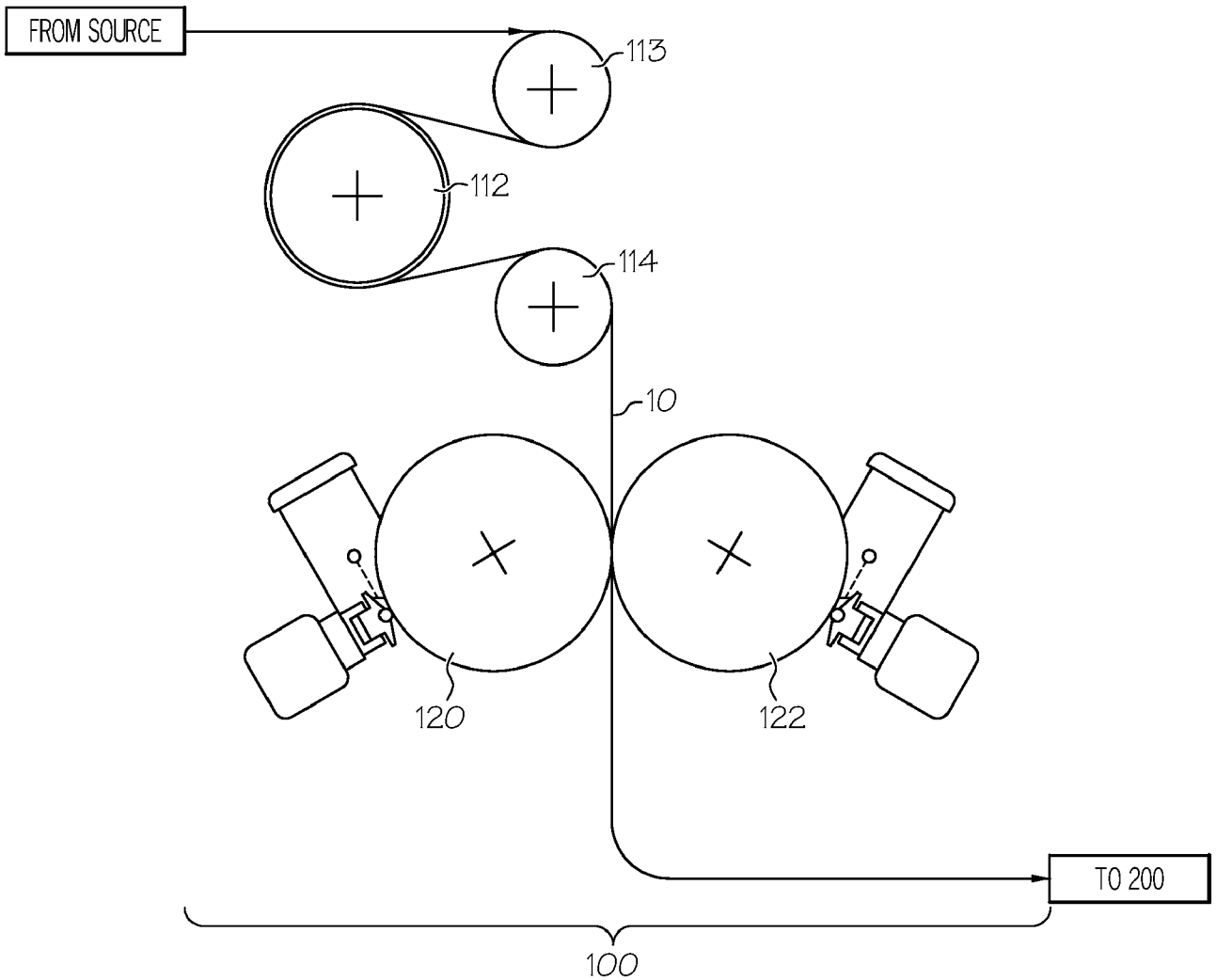
FIG. 3 is a schematic diagram of an alternative structure for a medium conditioning apparatus, having two moisture application rollers, one for applying moisture from each side of the web of medium material.

In the embodiment illustrated in FIG. 2, moisture is applied to the web 10 from only one side, namely the side adjacent the moisture application roller 120. It is believed, however, it may be advantageous to apply moisture either simultaneously or successively from both sides of the web 10 in order to ensure more uniform moisture penetration. Application of moisture from both sides also should ensure the same moisture content at both the outer surfaces of the web 10 so that one side is not substantially more or less moist than the other. Differences in relative moisture content at the two outer surfaces of the web 10 can lead to warpage or washboarding because the two sides will have dissimilar flexibility. FIG. 3 shows an alternative structure for a medium conditioning apparatus, wherein two moisture application rollers 120 and 122 are used to apply moisture from opposite sides of the web 10. In the illustrated embodiment, the two moisture application rollers 120 and 122 are shown directly opposite one another, to apply moisture to the web 10 at the same location along the web pathway. However, the two moisture application rollers 120 and 122 could less preferably be located at successive positions along the web pathway. In the latter case, it is preferred the web pathway for the web 10 as it traverses the two moisture application rollers 120 and 122 is somewhat serpentine, i.e. so the web 10 follows a somewhat serpentine or "S"-shaped path as it traverses the rollers 120 and 122. This way, the web 10 is drawn somewhat against both rollers, adjacent each of its outer surfaces, to ensure moisture penetration from each side.

The medium conditioning apparatus 100 may include various other desirable features. In one example, the applicator roll 120 can include a rubber surface or the like that can have a surface roughness within the range of about 0.4 microns to about 0.8 microns to facilitate liquid binding or retention thereon. In another example, because the entire face surface of the paper web 10 is being coated with water, the medium conditioning apparatus 100 may include a relatively smaller rod size as compared to a rod used on an iso-bar glue applicator described in the '546 patent incorporated above.

In other examples, it can be desirable to utilize heated liquid in the medium conditioning apparatus 100 within the range of about 25 to about 95 degrees Celsius, or even within the range of about 55 to about 95 degrees Celsius. Heated liquid can provide relatively greater system efficiency (i.e., greater energy efficiency) because more heat can be transferred out of a downstream heater and into the paper web 10. In addition or alternatively, heated liquid can lower the surface tension of the liquid so that the film of water lays down better on the applicator roll 120.

In still other examples, it can be desirable to rotatably drive any one or more of the idler rollers located downstream of the liquid applicator roller 120 of the medium conditioning apparatus 100. For example, in FIG. 2, a second idler roller, or another roller directing the paper web 10 out of the medium conditioning apparatus 100, can be driven. It can be beneficial to drive a roller having more paper web wrap. Driving one of the downstream idler rollers can lower the drag through the system and thereby lower the tension within the paper web. Thus, relatively lighter weight papers can be utilized with the medium conditioning apparatus 100, such as papers having a density below about 100 grams per square meter.

Figure 4:
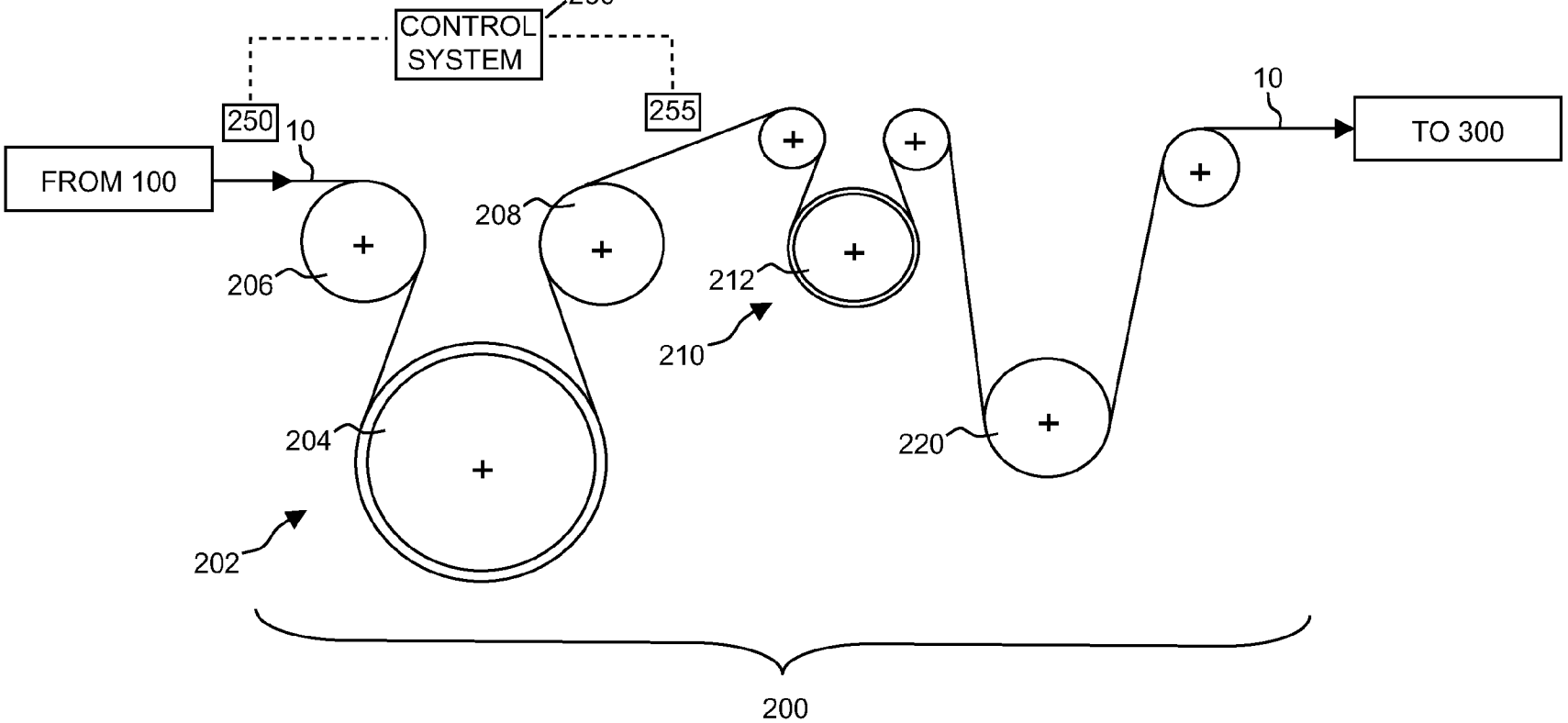
FIG. 4 is a schematic diagram of a web heating arrangement that can be used in a corrugating method.

On exiting the medium conditioning apparatus 100, the conditioned (e.g. moisture content preferably adjusting to about 6-9 wt. %) web of medium material 10 proceeds along a web path to and through a web heating arrangement 200 as illustrated schematically in FIG. 4. The web heating arrangement 200 can be physically arranged variously relative to the medium conditioning apparatus 100, such as having a portion of the web heating arrangement 200 disposed vertically above a portion of the medium conditioning apparatus 100, though other configurations are contemplated. In addition or alternatively, it is contemplated that either or both of the medium conditioning apparatus 100 and/or heating arrangement 200 can be included a portion of the single-facer 300 and/or double-backer 500, or can remain separate and independent.

The paper web 10 can proceed around yet another idler roller 206 and is directed around at least one, and possibly multiple, heat source(s) 202 prior to being corrugated or laminated. For example, the heat source 202 can include a steam drum 204 or the like, having a heated surface over which the web of medium material 10 travels. In the shown example, the idler roller(s) 206 can be arranged such that the thin film of water was applied to the side of the paper web 10 that will be down (i.e., in direct contact) to the heated surface of the heat source 202 (i.e., the side or face of the paper 10 that will directly contact the steam drum 204). In one example, the medium conditioning apparatus can supply enough water at the heat interface to keep the steam release through the paper to be substantially continuous to thereby protect the paper from overdrying.

One or more idler roller(s) 208 can guide or direct the web 10 away from the heat source 202. It can be beneficial to have some or all of the idler roller(s) 206, 208, or any other idler roller(s), be driven rollers. In addition or alternatively, the idler roller(s) 206, 208 can be movable, such as towards or away from each other, to adjust the wrap angle of the paper web 10 around the curved surface of the steam drum 204 so as to adjust the heating contact time (i.e., the dwell time) of the paper web 10 against the steam drum 204 such that the paper web 10 is heated more or less, as desired. In addition or alternatively, the temperature of the heat source 202 can be adjusted to adjust whether the paper web 10 is heated more or less, as desired. Though illustrated as a single steam drum 204, various numbers of heat source(s) can be used, and/or various other types heat source(s) 202 can also be used, such as stationary hot plates or the like (i.e., similar to those of FIG. 7).

As described herein, use of the medium conditioning apparatus 100 at locations upstream of where the paper is either corrugated or applied to another sheet, and especially with the subsequent application of heat to the paper, can provide amazing and unexpected results relating to the ability to control moisture and temperature of the paper material within the corrugator machinery. Therefore, by controlling the moisture and temperature of the paper material within the corrugator machinery, the dimensional stability of corrugated linerboard can be controlled. Because substantially the entire paper web is coated with water continuously and prior to being heated, it can be dimensionally stable such that it remains relatively flat not only through the assembly process, but also once it emerges as finalized, corrugated linerboard. Thus, the finalized corrugated linerboard will not warp after the assembly process as it dries over time (i.e., known as post-warp). In effect, flat corrugated linerboard produced by the corrugation machine will remain flat after drying over time.

The medium conditioning apparatus 100 applies water continuously to one side (face) of the paper web. Specifically, the water is applied to the side of the paper that will be down to the heat source 202 (i.e., the side or face of the paper that will directly contact the steam drum 204). When the paper web 10 contacts the heated surface, the water applied to the paper is either flashed into steam to both protect and heat the paper, or remains with the paper and is absorbed therein. Indeed, a portion of the steam may be absorbed into the paper web where it will condense back into liquid water and remain within the paper web.

As a result, the water will absorb generally uniformly into the paper web, and when heated, will diffuse generally uniformly into the paper web. Therefore, because of the uniform coating and distribution of the water, the paper web (or even the corrugated linerboard) will dry uniformly over time. In effect, the moisture content will not re-balance and warp the paper web or linerboard because of the uniform distribution.

The steam created by the improved method herein may only require heating to the evaporation conditions of 100 degrees Celsius (at sea level) with virtually no increase over atmospheric pressure. Moreover, because a portion of the water is absorbed into and remains within the paper web, the paper cannot be heated to a temperature above 100 degrees Celsius. This can be especially true at the interface layer of the paper and the heat source. As a result, the water in the paper can be adjusted over a moisture band from 5-10% while maintaining a near constant paper temperature because the paper is kept within the steady state water evaporation zone. Additionally, the steady-state temperature zone can be beneficial in providing an optimal gelatinization temperature for the starch adhesive.

In a modified form, the system and method described herein can also be used to deliberately impart a pre-warped (i.e., non-flat) dimension to a corrugated linerboard that will later encourage the linerboard to provide a relatively flat geometry via post-warp action during drying.

In addition or alternatively, because it is known that if liquid water resides within the paper web, the paper cannot be heated to a temperature above 100 degrees Celsius (i.e., above the boiling point), which can inhibit, such as prevent, the paper web from overheating and burning. Thus, by maintaining the paper web within the aforedescribed Steady State Evaporation stage, most of the energy being input is used to evaporate water, and the starch and paper temperatures will remain fairly constant. In addition or alternatively, because of the aforedescribed properties of water, a desired temperature gauge can be indirectly determined through the use of a moisture gauge. For example, if a specific moisture content of the paper web is maintained within a range of about 6-10%, the corresponding temperature range can be indirectly determined therefrom.

Further, devices that use boiler steam to transfer heat and moisture are on average 10% efficient, meaning that for every 10 kilograms of steam applied to the paper only 1 kilogram of water is absorbed by the paper. The boiler steam used in the conventional process must be replaced with fresh boiler feed water that must be treated with chemicals and then reheated to full boiler pressure and temperature (typically 14 Bar pressure and 200 degrees Celsius). In contrast, a majority, such as about 100 percent, of the water applied to the paper is either flashed into steam to both protect and heat the paper or remains with the paper and absorbed. The steam created by the improved method only needs to be heated to the evaporation conditions of 100 degrees Celsius (at sea level) with virtually no increase over atmospheric pressure.

Moreover, the deeper paper goes into the falling rate zone, the more energy is required to dry it to lower moisture content. The heat required to convert a kilogram of water to steam is 2257 kj/kg at standard conditions (example boiling water on a stove). Converting water on the surface of paper to steam requires about 1.5 times greater than the heat of evaporation alone. The heat required to drive a kilogram of water out of paper at 1.5% relative humidity can be four to five times greater than the heat of evaporation alone because water is retained by the fibers. Processes which dry paper down to 1-2% moisture are very energy inefficient. Thus, utilizing the method and apparatus described herein can dramatically improve energy efficiency in the manufacture of corrugated board.

In the illustrated embodiment, the web heating arrangement 200 may optionally further include a corrugating pretensioning mechanism 210 and/or a stationary zero-contact roll 220. For example, the zero-contact roll 220 can be at least one stationary roll that does not rotate as the web of medium material traverses its circumferential surface. Instead, a volumetric flowrate of air at a controlled pressure is pumped from within the zero-contact roll 220 radially outward through small openings or holes provided periodically and uniformly over and through the outer circumferential wall of the zero-contact roll 220. The result is that the passing web of medium material 10 is supported above the circumferential surface of the zero-contact roll 220 by a cushion of air.

In addition or alternatively, the pretensioning mechanism 210 can be provided and functions in a similar manner as the pretensioning mechanism 110 described above. The corrugating pretensioning mechanism 210 preferably is provided downstream of the medium conditioning apparatus 100 and upstream of the single-facer 300 in order that web tension in the medium material 10 can be independently selected based on separate and distinct web tension requirements in the medium conditioning apparatus 100 and in the single-facer 300. Though shown downstream of the heat source 202, the corrugating pretensioning mechanism 210 can also be provided upstream of the heat source 202, and/or numerous pretentioning mechanisms can be provided both before and after the heat source 202. By including separate pretensioning mechanisms 110 and 210, the web tension for the medium material 10 can be set independently in the medium conditioning apparatus 100 and on entering the single-facer 300 without regard to the tension requirements for the other stage in the process.

Alternatively, when the pretensioning mechanism 110 is not used, the corrugating pretensioning mechanism 210 still provides independent mean tension control of the web 10 on entering the single-facer 300 (and particularly the corrugating labyrinth 305), independent of the tension in that web 10 upstream. Note that the speed of the web 10 through the corrugating apparatus 1000 is controlled primarily by the demand for medium material through the corrugating labyrinth 305 based on the speed of the corrugating rollers 310 and 311 (described below), which are located downstream. Similarly as described above, the suction roller 212 for the corrugating pretensioning mechanism 210 is rotated in the same direction as the web 10 is traveling around its outer circumferential surface, but with that surface traveling at a slower linear speed than the web in order to provide the desired tension downstream. Ideally, the surface linear speed of the suction roller 212 would be exactly the same as the speed the web 10 is traveling, resulting in a mean tension in that web of zero on entrance into the corrugating labyrinth 305. In practice, however, this is difficult to achieve without causing slacking of the web 10 on entering the corrugating labyrinth 305. So some finite, non-zero tension typically is desirable in the web on entrance into the corrugating labyrinth 305, which can require the surface linear speed of the suction roller 212 to be modestly slower than the speed of the web 10. But as explained in the next paragraph, much lower mean tension values can be achieved using the corrugating pretensioning mechanism 210, such as 1-2 pounds per linear inch ("pli") or less, compared to the conventional pinch-roller or nip-roller method of pretensioning prior to corrugating. Precise downstream tension control also can be selected by adjusting the radial velocity (and correspondingly the surface linear velocity) of the suction roller 212.

Conventionally, tension in the web 10 on entering the single-facer 300, more particularly the corrugating nip 302 between the corrugating rollers 310 and 311, is adjusted using pretensioning nip rollers (pinch rollers) that are rotated at a circumferential lineal speed that is less than the speed of the web. The web passes through the nip rollers and is compressed therebetween, thereby imparting the desired downstream tension. However, this conventional mode of pretensioning suffers from numerous drawbacks, in particular: 1) very accurate tension control is not possible, and typically the downstream tension is maintained in the range of 2-3 pli, and 2) the nip rollers necessarily must compress/crush the medium material 10 between them to generate sufficient normal force to effect frictional engagement with the traveling web of material. The disclosed suction roller 212 is far superior in that it does not require crushing the medium material 10 to ensure suitable frictional engagement and consequent downstream tension control (it operates by sucking the medium to its surface). Also, it provides far more precise downstream tension control than is possible using nip rollers. Using the suction roller 212, it is possible to adjust the downstream tension lower than the 2-3 pli conventionally achieved, for example as low as nominally zero or near zero by adjusting the surface linear speed thereof to approach the linear speed of the web. In practice this may be somewhat impractical for reasons explained above. But using the suction roller 212, downstream tension in the web 10 on entry into the corrugating nip 302 preferably less than 2, preferably less than 1, pli are achieved.

Figure 7:
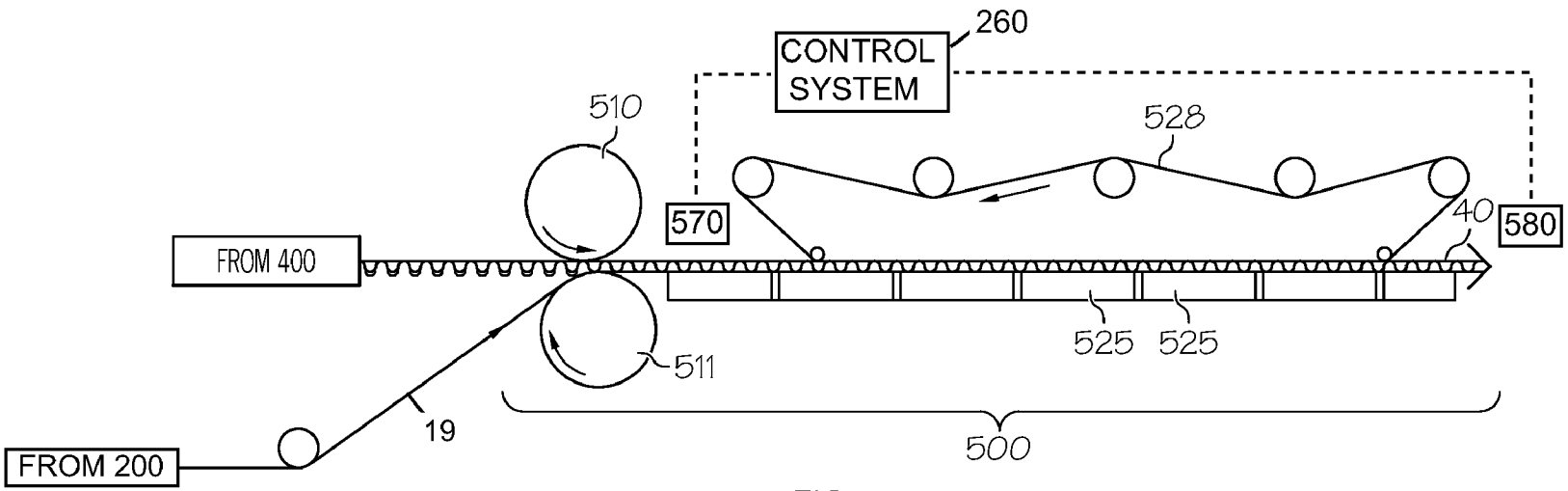
FIG. 7 is a schematic diagram of a double-backer that can be used in a corrugating method.

On exiting the web heating arrangement 200, the now conditioned, heated, and/or pretensioned web of medium material 10 enters the single-facer 300 along a path toward a nip 302 defined between a pair of cooperating corrugating rollers 310 and 311. The first corrugating roller 310 is mounted adjacent and cooperates with the second corrugating roller 311. Both the rolls 310 and 311 are journaled for rotation on respective parallel axes, and together they define a substantially serpentine or sinusoidal pathway or corrugating labyrinth 305 at the nip 302 between them. The corrugating labyrinth 305 is produced by a first set of radially extending corrugating teeth 316 disposed circumferentially about the first corrugating roller 310 being received within the valleys defined between a second set of radially extending corrugating teeth 317 disposed circumferentially about the second corrugating roller 311, and vice versa. Both sets of radially extending teeth 316 and 317 are provided so that individual teeth span the full width of the respective rolls 310 and 311, or at least the width of the web 10 that traverses the corrugating labyrinth 305 therebetween, so that full-width corrugations can be produced in that web 10 as the teeth 316 and 317 interlock with one another at the nip 302 as the rolls rotate. The corrugating rollers 310 and 311 are rotated in opposite angular directions as illustrated in FIG. 7 such that the web of medium material 10 is drawn through the nip 302, and is forced to negotiate the corrugating labyrinth 305 defined between the opposing and interlocking sets of corrugating teeth 316 and 317. On exiting the nip 302 (and corrugating labyrinth 305), as will be understood by those of ordinary skill in the art the medium material 10 has a corrugated form; i.e. a substantially serpentine longitudinal cross-section having opposing flute peaks and valleys on opposite sides or faces of the medium material 10.

After emerging from the corrugating labyrinth 305, the now-corrugated medium material 10 is carried by the second corrugating roller 311 through a glue nip 321 defined between that corrugating roller 311 and a first glue applicator roller 320. A thin film of glue 325 is applied to the surface of the applicator roller 320 from a glue reservoir 328 using a second thin film metering device 330. The second thin film metering device 330 is or can be of similar construction as the first thin film metering device 130 described above, except that minor modifications may be desirable as the present device applies glue, such as a high-solids or high-starch glue having a water content of only, e.g., 50-75 wt. % water, whereas the previous device applied a thin film of water. For the second metering device 330 discussed here, the small concave cavities 84 of the metering rod 78 (see FIGS. 2*b*-2*d*) provide spaces with respect to the smooth outer surface of the first glue applicator roller 320 so that small circumferentially extending ridges of adhesive remain on the surface of the applicator roller 320 as that surface rotates past the metering rod 78. Still, if adhesive is applied to the paper by the first thin film metering device 130, the second metering device 330 may be reduced, such as eliminated.

It should be noted that even though adhesive on the outer surface of the applicator roller 320 tends to be initially applied in the form of ridges, the adhesive tends to flow laterally and assume a uniform, flat and thin coating layer via cohesion. Of course, the viscosity of the adhesive in relation to the cohesion thereof determines the extent to which the adhesive coating becomes completely smooth. Preferably, the adhesive is a high-solids content adhesive (described in more detail below), having a viscosity of 15-55 Stein-Hall seconds.

The position of the metering device 330 is adjustable toward and away from the applicator roller 320 to precisely set the gap therebetween. When the metering device 330 is adjusted so that metering rod 78 is in virtual contact with the outer circumferential surface of the applicator roller 320, essentially all of the adhesive except that passing through the concave cavities between adjacent turnings of the wire 82 or grooves 86 in the rod 78 (see FIGS. 2*c*-2*d*) is removed from the outer circumferential surface of the applicator roller 320. On the other hand, when the metering rod 78 is spaced slightly away from the outer circumferential surface of the applicator roller 320, a coating of adhesive having greater thickness remains on the outer circumferential surface of the applicator roller 320. In a preferred embodiment the metering device 330 is positioned with respect to the applicator roller 320 to provide a uniform adhesive coating on the outer circumferential surface having the preferred thickness for the desired flute size as explained, e.g., in the '546 patent incorporated hereinabove. It will be understood that the optimal position for the metering device 330 will depend on the viscosity, the solids content, and the surface tension of the adhesive being used, as well as the size of the flutes (e.g. A, B, C, E, etc.). In conjunction with the metering device 330, it is possible to use a glue with very high solids content, such as at least 25, at least 30, at least 35, at least 40, at least 45, at least 50 weight percent solids, or greater, balance water, compared to other conventional glue film application systems.

After the corrugated medium material 10 emerges from the glue nip 321, it continues around the second corrugating roller 311 on which it is supported to and through a single-face nip 341 where a first face-sheet web 18 is contacted and pressed against the glue-applied exposed flute crests of the medium material 10. A single-face roller 340 presses the first face-sheet web 18 against the flute crests to produce a single-faced web 20 on exiting the single-facer 300.

Figure 5:
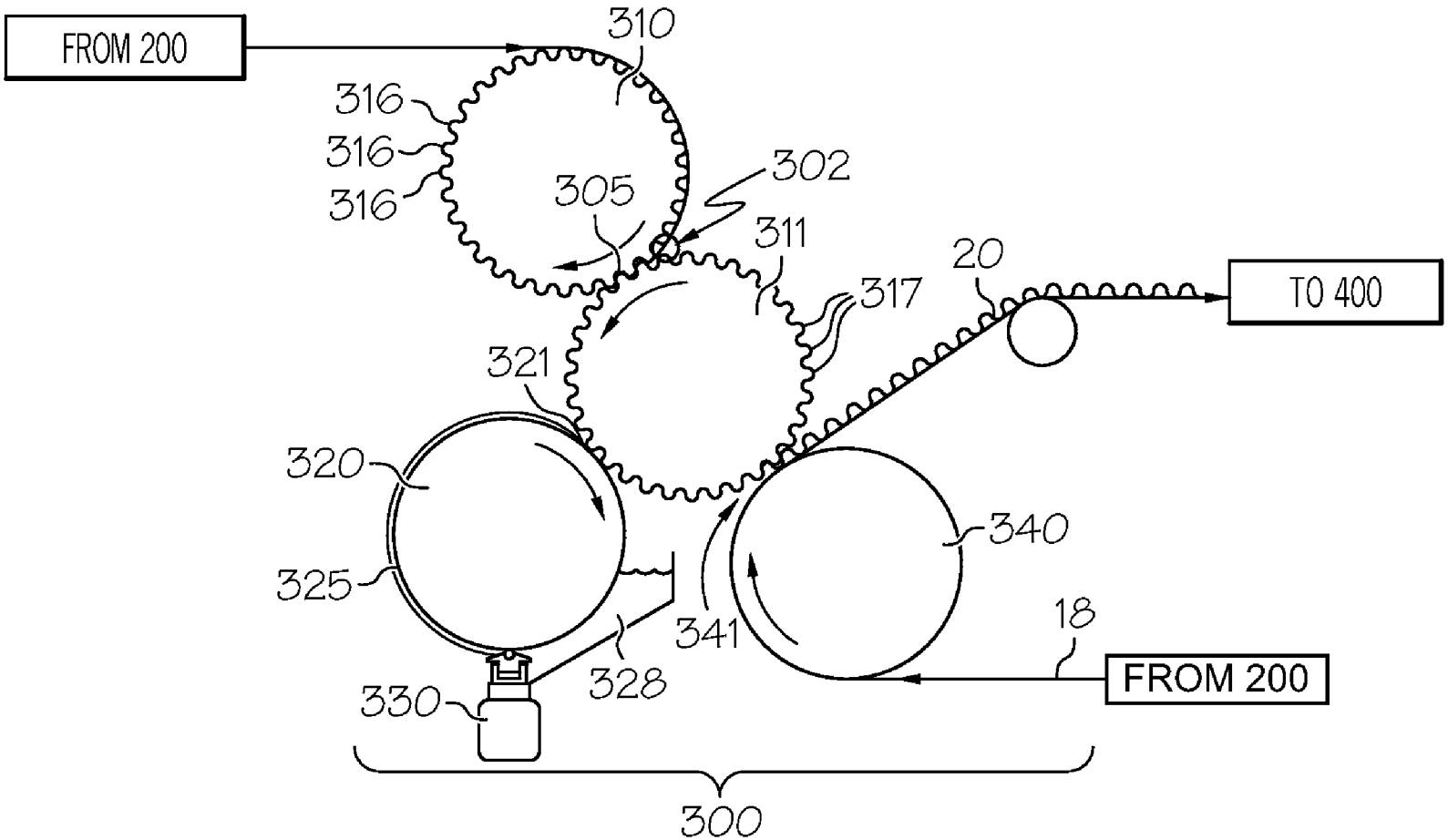
FIG. 5 is a schematic diagram of a corrugator/single-facer (referred to hereinafter as a "single-facer") that can be used in a corrugating method.

It can also be beneficial to condition the first face-sheet web 18 before it is coupled to the corrugated medium material 10. For example, a second medium conditioning apparatus can be disposed upstream of the single-facer 300 (e.g., such as upstream of the single-face roller 340) to separately and independently apply a generally continuous thin film of liquid to the first face-sheet web 18. The second medium conditioning apparatus can be separate and independent from said first medium conditioning apparatus 100, though can be substantially similar. Additionally, the first face-sheet web 18 can subsequently proceed through a second heating arrangement 200 similar to that experienced by the corrugated medium material 10, though the second heating arrangement can also be separate and independent. Thus, for clarity in FIG. 5, the first face-sheet web 18 is illustrated schematically as being provided "FROM 200," though it is to be understood that the corrugated medium material 10 and the first face-sheet web 18 can be processed through independent and separate sets of machinery. Moreover, if the first face-sheet web 18 is not heated, the notation "FROM 200" could be replaced by "FROM 100." Still, it is also conceivable that such processing of the corrugated medium material 10 and the first face-sheet web 18 could be performed on a single, multi-purpose machine.

Thus, the second medium conditioning apparatus can adjust the moisture content in said first face-sheet 18 to be in the range of 6-9 wt. % moisture, prior to being coupled to said web of medium material 10, by applying a substantially continuous thin film of water to the first face-sheet 18 using said second medium conditioning apparatus. Again, the water can be applied to the side of the paper that will be down to (i.e., directly contact) the heat source of the heating arrangement 200. Additionally, the water can be applied to the side of the first face-sheet 18 that will be directly coupled to the flutes of the corrugated medium material 10, applied to the opposite side, or even applied to both sides. A similar liquid can be applied to the first face-sheet 18 as is applied to the corrugated medium material 10, though various other liquids can also be used.

In a cold corrugating apparatus and associated method, the medium material 10 is formed (fluted) and the final product assembled without using heat to drive off excess water from the applied adhesive, which adheres both the first and second face-sheet webs 18 and 19 to the corrugated material medium 10. Thus, the adhesive used both in the single-facer 300 to adhere the first face-sheet web 18 and in the glue machine 400 to adhere the second face-sheet web 19 (discussed below) must have a higher solids and lower water content compared to traditional starch adhesives, which have anywhere from 75 to 90 wt. % water content. A preferred adhesive for use in the present invention exhibits several characteristics not common to adhesives used in conventional corrugators that use steam heat to drive of excess moisture.

The adhesive preferably includes in excess of 25%, 30%, 40%, or even 50% solids, and achieves a strong bond without requiring that its temperature be raised above a gel point threshold. Such a high-solids content adhesive begins to develop its bond quickly enough to hold the medium material 10 and the face-sheet web 18 or 19 together during the corrugation process so that the resulting laminate web can continue to be processed through the apparatus. The adhesive also provides a strong enough bond at low moisture levels so that no post application drying may be required to reduce the moisture level of the combined board below a threshold required for proper board structural performance.

Figure 6:
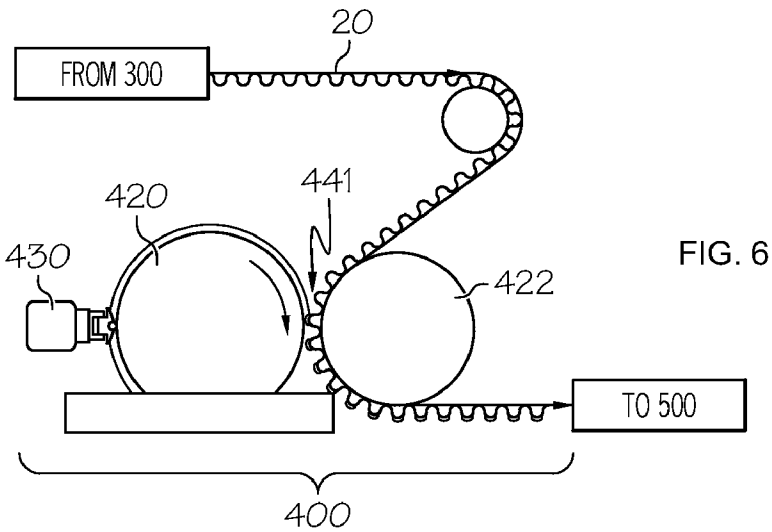
FIG. 6 is a schematic diagram of a glue machine that can be used in a corrugating method.

The single-faced web 20 exits the single-facer 300 and enters the glue machine 400 of FIG. 6 where a similar high-solids glue as described above is applied to the remaining exposed flute crests in order that the second face-sheet web 19 can be applied and adhered thereto in the double-backer 500. In a preferred embodiment, the glue machine is provided as described in the '546 patent incorporated hereinabove, and applies a similar high-solids content glue (40-50 wt. % solids, or higher) as described above. Briefly, the glue machine 400 has another thin film metering device 430 that is capable to accurately and precisely meter a thin film of the high-solids adhesive on the outer circumferential surface of the second glue applicator roller 420. The single-faced web 20 is carried around a rider roller 422 and through a glue machine nip 441 where glue is applied to the exposed flute crests of the passing single-faced web 20 as described in detail in the '546 patent, incorporated hereinabove. Still, if adhesive is applied to either or both of the paper webs 10, 18 by the other thin film metering device(s), the present metering device 430 may be reduced, such as eliminated.

The single-faced web 20, having glue applied to the exposed flute crests, then enters the double-backer 500 through a pair of double-backer rollers 510 and 511 (e.g., finishing nip rollers), where the second face-sheet web 19 is applied and adhered to the exposed flute crests and the resulting double-faced corrugated assembly is pressed together.

It can also be beneficial to condition the second face-sheet web 19 before it is coupled to the single-faced web 20. For example, a third medium conditioning apparatus can be disposed upstream of the double-backer 500 (e.g., such as upstream of the finishing nip roller 511) to separately and independently apply a generally continuous thin film of liquid to the second face-sheet web 19. The third medium conditioning apparatus can be separate and independent from said first and/or second medium conditioning apparatus 100, though can be substantially similar. Additionally, the second face-sheet web 19 can subsequently proceed through a third heating arrangement 200 similar to that experienced by the corrugated medium material 10 and first face-sheet web 18, though the third heating arrangement can also be separate and independent. Thus, for clarity in FIG. 7, the second face-sheet web 19 is illustrated schematically as being provided "FROM 200," though it is to be understood that the corrugated medium material 10 and the second face-sheet web 19 can be processed through independent and separate sets of machinery. Moreover, if the second face-sheet web 19 is not heated, the notation "FROM 200" could be replaced by "FROM 100." Still, it is also conceivable that such processing of the corrugated medium material 10, first face-sheet web 18 and/or the second face-sheet web 19 could be performed on a single, multi-purpose machine.

Thus, the third medium conditioning apparatus can adjust the moisture content in said second face-sheet web 19 to be in the range of 6-9 wt. % moisture, prior to being coupled to single-faced web 20, by applying a substantially continuous thin film of water to the second face-sheet web 19 using said third medium conditioning apparatus. Again, the water can be applied to the side of the paper that will be down to (i.e., directly contact) the heat source of the heating arrangement 200. Additionally, the water can be applied to the side of the second face-sheet web 19 that will be directly coupled to the flutes of the single-faced web 20, applied to the opposite side, or even applied to both sides. A similar liquid can be applied to the second face-sheet web 19 as is applied to the either of the corrugated medium material 10 or the first face-sheet web 18, though various other liquids can also be used.

Optionally, the double-backer 500 also may include, downstream from the finishing nip rollers 510 and 511, a series of stationary hot plates 525 defining a planar surface over which the finished corrugated board 40 travels. In this embodiment, a conveyor belt 528 is suspended over the hot plates and spaced a distance therefrom sufficient to accommodate the finished corrugated board 40 as it travels through the double-backer 500. The conveyor belt 528 frictionally engages the upwardly facing surface of the finished board 40, and conveys it through the double-backer 500 such that the downwardly facing surface is pressed or conveyed against the stationary hot plates 525.

It will be understood the hot plates 525 are optional components in the cold corrugating apparatus as disclosed herein, and may be omitted as unnecessary with the present method and apparatus, such as with use of the thin film of liquid, web heating arrangement(s) 200, and/or an adhesive of suitably high solids content. It is anticipated that as conventional corrugators are converted to the cold process disclosed herein that other structure for supporting the underside of the finished board 40 can replace the hot plates in the double-backer 500. For example, conveyor belts, tables, and/or air floatation tables could be used. This may further improve the energy efficiency of the process.

Corrugated board 40 made using the above-described equipment and the associated cold corrugating method will retain a greater proportion of its initial compressive strength because the corrugated medium material 10 is not substantially fractured or damaged. The avoidance of such fracture/damage in the web 10, despite being formed (fluted) at low temperature, is made possible through one or several of the improvement described herein.

In yet further example variations, it can be beneficial to continuously apply films of adhesive to some or all of the paper layers (i.e., corrugated medium material 10, first and second face-sheets 18, 19) to strengthen the paper fiber and permit reduction of the basis weight of the substrates. In short, using the medium conditioning apparatus 100 described herein to continuously apply an adhesive film onto each flat paper at a location upstream of where the paper is either corrugated or applied to another sheet (i.e., upstream of the single-facer or double-backer), and especially with the subsequent application of heat to the paper, can provide amazing and unexpected results of reducing the basis weight of the substrates by 15-35% or more, while also providing the ability to control moisture and temperature of the paper material within the corrugator machinery. It is to be appreciated that although previously described herein for applying water, the following discussion of the medium conditioning apparatus 100 can apply adhesive to the various paper layers.

Thus, the medium conditioning apparatus 100 can be used to apply continuous films of adhesive to some or all of the singleface substrates (i.e., the liner and the medium), while reducing, such as eliminating, the conventional, downstream starch adhesive application. In a further example, where a corrugated board is formed of three layers (i.e., a bottom layer, a corrugated medium layer, and a top layer), three separate medium conditioning apparatus 100 can be utilized to provide continuous films of adhesive to each layer upstream of the singlefacer 300 and/or doublebacker 500.

A water-based starch, sodium silicate or other similar adhesive is applied. In one example, the adhesive has a solids content of 15-55% solids, in a range of 1-5 grams per square meter on both the starch and the liner. It is possible to strengthen both the liner and medium by 25-30%, or even 25-50%. The medium may pick up more strength because it is generally lighter in weight, more open, and/or absorbs more deeply. Additionally, the medium may start out weaker, by weight, than the liner.

Preheaters can be used to gelatinize, but not fully dewater, the starch film. The preheaters are located downstream of the medium conditioning apparatus 100. The moisture content of the paper is maintained within the steady state evaporation zone to avoid crystallizing the starch. The adhesive coating on the medium paper can be applied to the side facing the liner so that water in the adhesive penetrates the surface of the paper, is dewatered sufficiently to avoid the adhesive picking off on the corrugating rolls, and/or provides uniform heating and protecting the fibers in contact with the heat source from damaging over temperature. Alternatively, the coating on the liner may be the side opposite the preheat surface to retain relatively more fluid on the surface.

The starch applications should remain fluid enough that the pressure between the singlefacer pressure roll and the corrugating roll causes the two films of starch to impregnate the liner and medium causing them to dewater sufficiently to set the bond. The bond can be achieved with little, such as substantially no more, glue applied in the singlefacer than currently used with conventional downstream starch adhesive application. Similar structure can be applied to the double-backer 500. The starch consumption would remain about the same, but the basis weight of both the liner and medium could be reduced, such as by about 15-30%.

It is also possible to use the medium conditioning apparatus 100 to simultaneously strengthen the paper fibers (e.g., so that basis weight can be reduced), and still bond the medium and liner together. Successful trials have been performed with cold setting (but relatively expensive) adhesives that are applied to and strengthen the liner as they bond the liner to the medium. However, it has conventionally proven difficult to apply a fluid (other than water) to the medium and not foul the corrugating rolls. It has been discovered that one solution is to, for a relatively short time, make an inexpensive stein-hall adhesive act like a cold setting adhesive and to strengthen both of the liner and the medium (i.e., not just the liner) by allowing one adhesive application to rewet the other in the pressure nip. One example of the relatively short time can be about 1-2 seconds, though other times are contemplated.

For example, the relatively high pressure within the nip of the singlefacer can squeeze water into the paper fibers, such that the adhesive requires little, if any, additional drying time as the squeezing action has removed the water from the adhesive. Because the adhesive in the medium can be gelatinized but not crystallized (since it remains within the steady state evaporation zone), the additional fluid coating on the liner will, under pressure, transfer some of its water to the medium, rewetting it and completing the bond between the two substrates.

Additionally, because the entire paper web is coated with adhesive continuously and prior to being heated, it will be dimensionally stable such that it remains relatively flat not only through the assembly process, but also once it emerges as finalized, corrugated linerboard. Thus, the finalized corrugated linerboard will not warp after the assembly process as it dries over time (i.e., known as post-warp). In effect, flat corrugated linerboard produced by the corrugation machine will remain flat after drying over time.

In addition to the foregoing description, it can be further beneficial to reduce, such as minimize, the amount of adhesive used to manufacture corrugated board over a portion, such as all, of the operational speed ranges of the corrugating machinery. It has been discovered that using one or more medium conditioning apparatus 100 to apply a water film onto each flat paper at a location upstream of where the paper is either corrugated or applied to another sheet (i.e., upstream of the single-facer or double-backer), and especially with the subsequent application of heat to the paper, can provide amazing and unexpected results relating to the ability to reduce, such as minimize, the amount of adhesive used to manufacture the corrugated board. The reduction of adhesive used can be applied over a portion, such as all, of the operational speed ranges of the corrugating apparatus 1000.

Conventional corrugating machinery must constantly change the amount of adhesive applied to the various sheets with changes in operational speed of the machinery. Generally, an increase in speed leads to a decrease in the amount of adhesive used. Control of multiple variables has historically made it difficult to maintain consistency in adhesive application, especially over a large and changing operational speed range of the machinery.

In short summary, the medium conditioning apparatus 100 can include an adhesive that is provided within an adhesive tray and is picked up through rotation of the applicator roll. Utilizing a grooved rod metering assembly with different groove open areas, the medium conditioning apparatus 100 assembly can provide various fluid thicknesses, such between 5 microns and 50 microns (essentially a 10 to 1 range). Thus, the metering system can coat the paper web with an adjustable, continuous film of adhesive.

In other examples, conventional adhesive metering systems can also be utilized, such as whereby two rollers are separated from each other by a fixed distance generally equal to the desired adhesive thickness on the sheet. One of the rollers is a guide roller for moving the sheet, while the other roller picks up adhesive from an adhesive tray. Thus, adjusting the fixed distance between the two rollers can determine the adhesive thickness to be applied to the sheet. In another example, a doctor blade and anilox roll system can also be utilized. Utilizing the medium conditioning apparatus 100 to apply a liquid film (e.g., water, adhesive, and/or additive) onto each flat paper at a location upstream of where the paper is either corrugated or applied to another sheet allows the ability to reduce, such as minimize, the amount of adhesive used to form the corrugated board.

The glue machine, either a medium conditioning apparatus 100 described herein or even the conventional type, can be operated at a constant and extremely low glue weight over the entire speed range when applying water to the liner, medium, or both. In the case of the medium conditioning apparatus 100, one example would be to use a rod giving a film thickness of 0.004" (100 microns) or less. In the case of the conventional machines, it would mean using a fixed glue roll to metering roll gap of 0.008" (200 microns) or less at all speeds from 5-450+ meters per minute.

The same or similar operational parameters can similarly be applied to the single facer 300 (i.e., using a fixed glue roll to metering roll gap of 0.008" (200 microns) or less at all speeds from 5-450 meters per minute). Thus, utilizing the medium conditioning apparatus 100 to maintain medium moisture content in the proper range at all speeds can make possible a reduction in medium basis weight across the board on virtually all grades, in addition to large waste, starch and energy savings.

Using the medium conditioning apparatus 100 also permits control of the temperature of the system in a substantially isothermal state, which can provide at least the following benefits: a.) reduces both starch by 40-50% or more and energy by 30-60% or more; b.) simplifies the operation and control of the entire corrugator by widening the process window; c.) reduces controllable waste by 30-50% or more by delivery flat perfectly bonded board at virtually any speed; and d.) improves productivity in the conversion side by 25-40%.

In one example, operating parameters can start with a film thickness on the roll that is 0.0006" thick and then apply it with a 15-60% speed differential that attenuates the film even further. Then we convert it to steam, which condenses to vapor and rises through the paper at very low pressure heating it and protecting the fibers from damage. While it can be useful to use a steam shower to restore some of the moisture to the medium for fluting, it may not fully restore the original water drop values and because it can be difficult to control is always under or over moisturizing the medium (which can cause damage to the medium). In addition, when preheating we historically do nothing for the liners except make them less absorbent.

Thus, using the medium conditioning apparatus 100 described herein, along with temperature control, provides for increased control of moisture in the medium. By applying the water prior to heating, we give the water sufficient time to penetrate (which may take as long as 0.4 seconds) and prepare the surface for starch penetration before the starch arrives. In addition this roughens the surface, swells the fibrils and protect them from damage by over drying. When we apply lower levels of starch, we are really acting more like a dry strength surface treatment to strengthen the fibers.

The fibrils of the two papers (which have a very similar composition to that of starch) become surrounded by the starch film and entangled with each other. When the glue dries the fibers are bonded and strengthened at the same time. Thus, the fibers are effectively welded together, instead of the conventional manner of separating them by a thick adhesive layer. We want to coat the fibers and fibrils with sufficient starch to fully wet out and penetrate both surfaces. This can be dramatically helped by heating the surface enough to generate steam after the water is applied, though heating may also not be used.

Thus, using such an isothermal process provides the long awaited result of increased, such as complete, control of moisture and temperature independent of starch application. This allows the corrugating apparatus 1000 to accomplish any or all of the following: a.) run constant glue curves by grade and for most grades the same glue curves at the single-facer 300 and doublebacker 500; b.) run a constant wrap roll position by grade and for most grades the same wrap roll position on all preheaters; c.) run constant liner moisture and constant liner temperature in the single-facer 300 regardless of speed; d.) run constant medium moisture and constant medium temperature in the single-facer 300; e.) do fast control of warp with the medium conditioning apparatus 100. Additional benefits can include any or all of the following: 1. reduce, such as eliminate, warp-especially post warp; 2. reduce, such as eliminate, score cracking; 3. reduce, such as eliminate, medium fracture on all mediums; 4. increase PINs, ECT and FCT by >10% at all speeds, allowing the substitution of a least one basis weight grade on all board combinations; 5. reduce, such as eliminate, all steam showers; 6. increased heat transfer efficiency; 7. lower boiler pressure required; 8. lower starch consumption; 9. lowers the skill level required to operate the corrugator; 10. increase converting department efficiency by 25-35%, allowing the elimination of one shift of production; 11. 15-35% reduction in liner paper basis weight with substantially equivalent ECT and BCT; and 12. provides a greatly reduced timeframe for return on investment of equipment cost.

Further benefits can include an increase in flat crush of the manufactured corrugated board. Flat crush is a measure of the resistance of the flutes of a corrugated (fluted) board to the pressure applied perpendicularly to the surface (i.e., flute rigidity), typically at the ambient conditions of 23° C. and 50 percent humidity over a 24-hour period, though other conditions can be used. A high flat crush value indicates a combination of good flute formation and at least adequate strength medium. Low flat crush may indicate a number of conditions including low strength medium, leaning flutes and crushed flutes. In short, increased flat crush provides increased resistance, which provides less flute deformation.

Some surprising and unexpected results from one experimental installation are as follows: Conventional example corrugating equipment was averaging adhesive usage of 15.3 Grams per square meter (GSM, about 3.15 lbs/1000 $ft^2$) C flute equivalent on an Agnati corrugator. Utilizing the medium conditioning apparatus 100 and iso-thermal methods discussed herein, such as running the single facer with the medium conditioning apparatus 100 at minimum glue gap at all speeds, average adhesive usage for the corrugating equipment has been reduced to 4.6 GSM (0.95 lbs/1000 $ft^2$), or even less. Thus, using the novel apparatus and methods discussed herein, average adhesive usage for the corrugating equipment can be dramatically reduced to be only 30% of conventional machines.

Other surprising and unexpected experimental results include: a.) Used the medium conditioning apparatus 100 to successfully make doublewall corrugated board with both single facers at minimum gap (0.004") at all speeds. This is less than half of the glue gap historically used to run at highest speed (and it has also been performed over the entire speed range) and resulted in an increase in speed from 160 meters per minute ("mpm") to 180 mpm.

b.) Used one medium conditioning apparatus 100 on the singlefacer 300 and one medium conditioning apparatus 100 on the doublebacker 500 which allowed lowering of the doublebacker steam pressures down to 1 bar (14.7 psi) on singlewall board while maintaining optimum bonding and speed.

c.) At constant pressures (1 and 2 bars) the measured condensate delivery of the first two hot plates with and without medium conditioning apparatus 100 determined that at both pressures condensate generation increased as much as 50% when the medium conditioning apparatus 100 was operating. This means that we are transferring more heat at a higher efficiency for a given temperature difference. This has broad implications for reducing boiler fuel consumption, even further increasing the overall manufacturing efficiency.

d.) Increased doublebacker 500 temperatures by raising steam pressure to its maximum of 15 bar (over 200 psi) and proved that water from the medium conditioning apparatus 100 would still protect the bottom liner without raising glue weight.

e.) Determining how low we can go in singlefacer 300 pressures. We have tested 100 and 125 psi successfully. Based on calculations, it is expected to be able to bond between 75-100 psi, 50-75 psi, or even lower, when using the medium conditioning apparatus 100 on both medium and liner while running minimum glue gap in the singlefacer 300.

Further surprising and unexpected results are discussed as Example 1, which includes the following experimental data of Table 1:

TABLE 1

| Modification | BEFORE grams per square meter | BEFORE LBS/1000 ft2 | AFTER grams per square meter | AFTER LBS/1000 ft2 | TOTAL SAVINGS | DIFFERENCE TO PREVIOUS |
|---|---|---|---|---|---|---|
| ADD ISO-BAR GLUE | 15.30 | 3.15 | 11.00 | 2.26 | 28.10% | 28.10% |
| ADD MCA TO DB LINER | 15.30 | 3.15 | 8.90 | 1.83 | 41.83% | 19.09% |
| ADD MCA TO SF LINER | 15.30 | 3.15 | 7.90 | 1.63 | 48.37% | 11.24% |
| ADD MCA TO CORR. MEDIUM | 15.30 | 3.15 | 4.70 | 0.97 | 69.28% | 40.51% |

In Example 1, the two columns labeled "BEFORE" illustrate the adhesive consumption of a conventional corrugator apparatus to be about 15.3 grams per square meter or about 3.15 pounds of adhesive per 1000 $ft^2$ of paper. First, an iso-bar glue machine (e.g., as discussed above and in the '546 patent) was added to the conventional corrugator apparatus to more precisely apply glue. This first change resulted in a reduction of adhesive used to about 11 grams per square meter or about 2.26 pounds of adhesive per 1000 $ft^2$ of paper, or a 28.10% overall reduction of adhesive usage. Second, a medium conditioning apparatus ("MCA") was added upstream of the doublebacker 500 ("DB") to adjust the moisture content in the second face-sheet web 19 ("DB LINER"). This second change resulted in a further reduction of adhesive used to about 8.9 grams per square meter or about 1.83 pounds of adhesive per 1000 $ft^2$ of paper, or a 41.83% overall reduction of adhesive usage.

Third, a medium conditioning apparatus was added upstream of the single-facer 300 ("SF") to adjust the moisture content in the first face-sheet web 18 ("SF LINER"). This third change resulted in a further reduction of adhesive used to about 7.9 grams per square meter or about 1.63 pounds of adhesive per 1000 $ft^2$ of paper, or a 48.37% overall reduction of adhesive usage. Finally, a medium conditioning apparatus was added upstream of the corrugating labyrinth 302 to adjust the moisture content in the medium material 10 ("CORR. MEDIUM"). This final change resulted in a further reduction of adhesive used to about 4.7 grams per square meter or about 0.97 pounds of adhesive per 1000 $ft^2$ of paper, or a 69.28% overall reduction of adhesive usage. Thus, by applying the method and apparatus discussed herein to each of the paper webs 10, 18, 19, the surprising and unexpected results of Example 1 show that overall adhesive usage for producing the same corrugated board 40 was reduced by 69.28%, which represents dramatic time and cost savings.

In addition to the foregoing description, the method and apparatus can also provide some or all of the following additional aspects. Applying an extremely thin film of water accurately to paper with the ability to vary the application rate in lbs per 1000 $ft^2$ over as much as a 200 to 1 range as the corrugator progresses through its speed range. One optimum range for the water film thickness on the applicator roll is between 0.0002" and 0.002" essentially a 10 to 1 range.

The addition or substitution of starch for water on the surface of the applicator roll can increase the strength of the individual papers at the same time the moisture content is being controlled. A speed difference between the flat paper web lineal speed and the surface lineal speed of the applicator roll (having the water film on its surface for application to the traveling flat web) of between 5-95% or between 105% and 200% can provide enough of a wipe ratio to evenly distribute the film over the irregular shape of the paper. A speed difference can be provided between the flat paper web lineal speed and the surface lineal speed of the applicator roll (having the water film on its surface for application to the traveling flat web) of between 95-105% if the film is first metered onto a second roll and then transferred to the applicator roll in a nip. Application of the water to the side of the paper to be heated can be beneficial such that water vapor rises through the entire paper to exit insuring uniform heating and protecting the fibers in contact with the heat source from damaging over temperature. Application of the water before the paper is heated can maintain an internal water (e.g., water inside the paper fibers) at a relatively high level to avoid loss of fiber strength and flexibility.

Varying the water applied relative to web lineal speed can compensate for the increased heat transfer per square foot at slower line speeds. Maintaining near constant temperature at all speeds independent of moisture content can allow the moisture to be adjusted substantially independent of temperature. The water in the paper can be adjusted over a moisture band from 5-10% with complete freedom while maintaining a near constant paper temperature because we stay within the steady state evaporation zone.

One or more moisture measurement device(s) 250, 255 and a corresponding control system 260 can be used for one or all separate web(s) 10, 18, 19 to be heated to provide closed loop control of moisture in each individual web; e.g. each of the three individual paper sheets that form a conventional three-layer corrugated linerboard. The moisture measurement device(s) can measure moisture in the paper before and/or after the paper is heated by the web heating arrangement 200. In addition or alternatively, a moisture measurement device 570 and a corresponding control system 260 for the combined board 40 (e.g. three-layer corrugated linerboard after all sheets have been combined and adhered to produce the laminate product) can be used to provide closed loop control of moisture in the finished product 40. In addition or alternatively, a warp measurement device 580 and a corresponding control system 260 for the combined board can provide closed loop control of warp in the finished product 40. It is to be understood that the various control systems discussed can be a single control system or multiple control systems that may or may not be operatively coupled together.

The measurement devices and control systems mentioned above can all can provide feedback control to the water-application system, such as by controlling the applicator roll surface lineal speed relative to paper speed in order adjust the amount of water transferred to the paper in order to provide optimum moisture input into the traveling flat web(s) to achieve moisture content within the desired range at the prevailing temperature or temperatures. It is recognized that an iterative process of trial and error may be desirable to discover optimal values, as well as other factors, to achieve a water content in the web 10 within the desired 6-9 wt. % range. For example, these and other variables may be adjusted taking into account the initial moisture content in the medium material web 10, which may vary from batch to batch, based on ambient weather conditions, production conditions, etc. It is contemplated that these control systems and adjustment processes can be manual, partly automated, or fully automated, and/or may include various algorithms, mathematical formulas, predetermined charts, etc. Additionally, these control systems and adjustment processes can alter operation of some or all portions of the corrugating apparatus 1000.

Addition or substitution of a low solids (<55%) water based corrugating adhesive like starch, sodium silicate, etc. for the water in the medium conditioning apparatus 100 can provide some strength improvement to be imparted to the individual papers as they are being protected from overheating. Addition or substitution of a fiber strengthening additive for the water in the medium conditioning apparatus 100 can be performed so that some strength improvement can be imparted to the individual papers as they are being protected from overheating.

The starch solids for the medium (e.g., 10) and liner(s) (e.g., 18, 19) may be different. For example, relatively more starch solids can be used on the liner. A cleaning/scraping device called a doctor blade may be used on the surface of the preheat cans to keep them clean. A release coating, such as tungsten carbide embedded with Teflon, may be used on the preheat can surface. An inert filler, such as kaolin clay, may be used to increase the solids content of the adhesive while maintaining a lower viscosity.

The starch may be substantially 100% cooked (e.g., gelatinized) prior to application to the liner or medium. The coating on the liner may be the side opposite the preheat can surface to retain more fluid on the surface. Alternatively, the adhesive can be applied to the side to be heated so that water vapor rises through the entire paper to exit insuring uniform heating and protecting the fibers in contact with the heat source from damaging over temperature. The coating on the medium may be the side opposite the preheat can surface to retain more fluid on the surface. Alternatively, the adhesive can be applied to the side to be heated so that water vapor rises through the entire paper to exit insuring uniform heating and protecting the fibers in contact with the heat source from damaging over temperature.

The pressure of the corrugating rolls can impregnate the adhesive applied to the medium deeply into the fibers for added strength. Adhesives bond to themselves more readily that to other materials. By applying separately to both materials, an advantage is gained in that the individual fibers on the surfaces of both substrates are fully coated with adhesive prior to bringing the two materials into contact.

Because the adhesive in the medium can be gelatinized but not crystallized (e.g., since it remains within the steady state evaporation zone during heating and does not have sufficient resonance time to dewater by capillary action before bonding), the more fluid coating on the liner can, under pressure, transfer some of its water to the medium, rewetting it and completing the bond between the two substrates. This can require far less adhesive to make the bond than if the adhesive is applied only to the medium or liner itself.

By adding water resistant additives to the starch applied to the medium we can reduce, such as eliminate, the application of wax to medium. For example, by adding water resistant additives to the liquid applied to the liner and coating the outside liner with a barrier we can reduce, such as eliminate, the application of wax yet make a greater, such as fully, water resistant box that will stand up to direct immersion in water or ice.

The glue machine(s), either the iso-bar type (e.g., see the '546 patent discussed herein) or the conventional type, can be operated at a constant and extremely low glue weight over the entire speed range when applying water to the liner, medium, or both. The amount of adhesive used can be reduced, such as minimized, to manufacture corrugated board over a portion, such as all, of the operational speed ranges of the corrugating machinery (i.e., 5-450+ meters per minute).

The medium conditioning apparatus 100 can be used to control the temperature (e.g., an isothermal system or the like) and moisture in the medium independent of starch application. Bonding pressures and/or steam pressures can be lowered while maintaining optimum bonding and speed.

Because the medium conditioning apparatus 100 coats the paper web(s) 10, 18, 19 with a substantially continuous film of liquid, warping of the final corrugated board 40 can be controlled independently of bonding, as well as substantially eliminating washboarding, score-cracking, and/or damage to sensitive and/or coated papers. Additionally, virtually constant glue weight can be used at substantially any speed, which can provide further starch savings and/or better quality at substantially any speed. Additionally, less total liquid (e.g., such as water) can be applied, and less evaporated liquid can mean stronger, stiffer board that can equilibrate to a final moisture relatively sooner.

It is to be understood that the names given to specific stages of a corrugating apparatus 1000 herein (i.e., "medium conditioning apparatus," "web heating arrangement," "single-facer," "glue machine" and "double-backer"), as well as order of operation identifiers (i.e., "first," "second," "third," "fourth") are intended merely for convenience and ease of reference for the reader, so he/she can more easily follow the present description and the associate drawings. It is in no way intended that each of these stages or 'machines' must be a single, discreet or unitary machine or device, or that specific elements (such as the pretensioning mechanisms 110 and/or 210) need to be provided together or in close association with the other elements described herein with respect to a particular stage or 'machine,' or that particular operations must occur in a particular order or using a particular machine. It is contemplated that various elements of the disclosed corrugating apparatus 1000 can be rearranged, or located in association with the same or different elements as herein described. For example, the medium conditioning apparatus and the pre-corrugating web tensioner as those 'machines' are described herein may be combined, with or without the same elements as described herein, or with additional cooperating elements, in a single 'machine.'

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A method comprising the steps of:

adjusting moisture content in a traveling web of medium material by applying a substantially continuous first thin film comprising water and adhesive to an exposed surface thereof so that said web of medium material comprises 6-9 wt. % moisture following the adjustment;

thereafter heating said web of medium material to a temperature less than or equal to about 100° C., such that said medium material retains 6-9 wt. % liquid moisture therein after said heating as a result of said adjusting step; and thereafter corrugating said web of medium material, wherein said surface remains exposed during said corrugating, to produce a corrugated web, wherein said web of medium material retains 6-9 wt. % moisture, and is at temperature less than or equal to about 100° C., immediately prior to said corrugating step as a result of said adjusting step.

2. A method of claim 1, said web of medium material comprising 7-9 wt. % moisture following said adjusting step.

3. A method of claim 1, further comprising the steps of:

a) adjusting moisture content in a first web of liner material so that said first web of liner material comprises 6-9 wt. % moisture following the adjustment in this step; and b) thereafter coupling said first web of liner material to said corrugated web to produce a single-faced web.

4. A method of claim 3, comprising adjusting the moisture in said first web of liner material by applying a substantially continuous second thin film of liquid thereto.

5. A method of claim 4, said liquid in said second thin film comprising an adhesive.

6. A method of claim 5, comprising adhering said first web of liner material to said corrugated web via said adhesive in said second thin film of liquid applied on said first web of liner material.

7. A method of claim 6, excluding a separate application of adhesive to flute crests on said corrugated web to adhere said first web of liner material thereto.

8. A method of claim 3, further comprising, intermediate steps (a) and (b) in claim 3, heating said first web of liner material to a temperature less than or equal to about 100° C., such that said first web of liner material retains liquid moisture therein after heating.

9. A method of claim 3, further comprising the steps of:

a) adjusting moisture content in a second web of liner material so that said second web of liner material comprises 6-9 wt. % moisture following the adjustment in this step; and b) thereafter coupling said second web of liner material to said corrugated web, opposite said first web of liner material, to produce a double-faced web.

10. A method of claim 9, comprising adjusting the moisture in said second web of liner material by applying a substantially continuous second thin film of liquid thereto.

11. A method of claim 10, said liquid in said second thin film comprising an adhesive.

12. A method of claim 11, comprising adhering said first web of liner material to said corrugated web via said adhesive in said second thin film of liquid applied on said second web of liner material.

13. A method of claim 12, excluding a separate application of adhesive to flute crests on said corrugated web to adhere said second web of liner material thereto.

14. A method of producing a corrugated product, comprising the steps of:

providing a pair of corrugating rollers that cooperate to define, at a nip therebetween, a corrugating labyrinth between respective and interlocking pluralities of corrugating teeth provided on said corrugating rollers;

providing a medium conditioning apparatus upstream of said corrugating rollers;

providing a heating arrangement downstream of said medium conditioning apparatus and upstream of said corrugating labyrinth;

feeding a web of medium material along a web pathway through said medium conditioning apparatus to adjust the moisture content in said web of medium material to be in the range of 6-9 wt. % moisture by applying a substantially continuous first thin film of liquid to an exposed surface of the web of medium material using said medium conditioning apparatus, wherein said first thin film of liquid comprises water and adhesive, subsequently feeding said web of medium material through said heating arrangement to heat said web of medium material via transfer of thermal energy from said heating arrangement to a temperature less than or equal to about 100° Celsius, and subsequently feeding said web of medium material through said corrugating labyrinth, said surface remaining exposed in said corrugating labyrinth, wherein said web of medium material retains 6-9 wt. % moisture, and is at a temperature less than or equal to about 100° C., immediately prior to entering said corrugating labyrinth as a result of having had its moisture content adjusted in said medium conditioning apparatus.

15. A method according to claim 14, further comprising adjusting the moisture content in said web of medium material to be in the range of 7-8 wt. % moisture prior to said web entering said corrugating labyrinth.

16. A method according to claim 14, wherein the moisture content in said web is adjusted in said range by providing a precisely metered thin film of liquid onto a surface of a moisture application roller, and conveying said web past and against said surface thereof.

17. A method according to claim 16, wherein said medium conditioning apparatus comprises a metering rod that is uniformly urged toward said surface of said moisture applicator roller to produce a uniform thickness coating of liquid on said surface, said metering rod having a series of axially spaced grooves in an outer surface thereof.

18. A method according to claim 14, wherein said heating arrangement comprises at least one heated surface over which the web of medium material travels.

19. A method according to claim 18, wherein the at least one heated surface includes a steam drum.

20. A method according to claim 14, said method being carried out to produce a single-faced corrugated product from said web of medium material, which is initially un-corrugated, and one additional web of un-corrugated material.

21. A method according to claim 20, wherein a high-solids-content adhesive is used to glue the one additional web of un-corrugated material to one side of said web of medium material after it is corrugated in said corrugating labyrinth.

22. A method according to claim 21, said high-solids content adhesive comprising at least 25 wt. % solids.

23. A method according to claim 22, said high-solids content adhesive comprising at least 40 wt. % solids.

24. A method according to claim 14, said method being carried out to produce a double-faced corrugated product from said web of medium material, which is initially un-corrugated, and two additional webs of un-corrugated material.

25. A method of producing a corrugated product, comprising the steps of:

providing a single-facer that is adapted to couple a corrugated web of medium material to a first face-sheet to form a single-faced web, said single-facer comprising a pair of corrugating rollers that cooperate to define, at a nip therebetween, a corrugating labyrinth between respective and interlocking pluralities of corrugating teeth provided on said corrugating rollers;

adjusting the moisture content in said corrugated web to be in the range of 6-9 wt. % moisture, prior to said web entering said corrugating labyrinth, by applying a substantially continuous first thin film of liquid comprising water and adhesive to an exposed surface of said web, said surface remaining exposed in said corrugating labyrinth;

adjusting the moisture content in said first face-sheet, upstream of where said first face-sheet is coupled to said corrugated web, to be in the range of 6-9 wt. % moisture by applying a substantially continuous second thin film of liquid to the first face-sheet; and heating said first face-sheet, downstream of where said second thin film of liquid is applied to said first face-sheet, to a temperature less than or equal to about 100° Celsius, wherein said first face-sheet retains 6-9 wt. % moisture therein after said heating as a result of said adjusting step, and coupling said first face-sheet to said corrugated web to produce said single-faced web.

26. A method according to claim 25, further comprising the step of heating said corrugated web, downstream of where said first thin film of liquid is applied to said corrugated web and upstream of said corrugating labyrinth, to a temperature less than or equal to about 100° Celsius.

27. A method according to claim 25, wherein the moisture content in said first face-sheet is adjusted in said range by providing a precisely metered thin film comprising water and adhesive onto a surface of a moisture application roller, and conveying said first face-sheet past and against said surface thereof.

28. A method of producing a corrugated product, comprising the steps of:

providing a single-facer that is adapted to couple a corrugated web of medium material to a first face-sheet to form a single-faced web, said single-facer comprising a pair of corrugating rollers that cooperate to define, at a nip therebetween, a corrugating labyrinth between respective and interlocking pluralities of corrugating teeth provided on said corrugating rollers;

adjusting the moisture content in said corrugated web to be in the range of 6-9 wt. % moisture, prior to said web entering said corrugating labyrinth, by applying a substantially continuous first thin film of liquid comprising water and adhesive to an exposed surface of said web, said surface remaining exposed in said corrugating labyrinth;

providing a double-backer downstream of said single-facer that is adapted to couple said single-faced web to a second face-sheet to form a corrugated board;

adjusting the moisture content in said second face-sheet to be in the range of 6-9 wt. % moisture, upstream of where said second face-sheet is coupled to said single-faced web, by applying a substantially continuous second thin film of liquid to the second face-sheet; and heating said second face-sheet, downstream of where said second thin film of liquid is applied to said second face-sheet, to a temperature less than or equal to about 100° Celsius, wherein said second face-sheet retains 6-9 wt. % moisture therein after said heating as a result of said adjusting step; and coupling said second face-sheet to said single-faced web to produce said corrugated board.

29. A method according to claim 28, further comprising the step of heating said corrugated web, downstream of where said first thin film of liquid is applied to said corrugated web and upstream of said corrugating labyrinth, to a temperature less than or equal to about 100° Celsius.

30. A method of claim 29, further comprising the steps of adjusting the moisture content in said first face-sheet, upstream of where said first face-sheet is coupled to said corrugated web, to be in the range of 6-9 wt. % moisture by applying a substantially continuous third thin film of liquid to the first face-sheet.

31. A method according to claim 30, further comprising the step of heating said first face-sheet, downstream of where said third thin film of liquid is applied to said first face-sheet and upstream of where said first face-sheet is coupled to said corrugated web, to a temperature less than or equal to about 100° Celsius.

32. A method according to claim 28, wherein the moisture content in said second face-sheet is adjusted in said range by providing a precisely metered thin film comprising water and adhesive onto a surface of a moisture application roller, and conveying said second face-sheet past and against said surface thereof.

33. A method of producing a laminate product, comprising the steps of:

adjusting moisture content in a traveling web of medium material so that said web of medium material comprises 6-9 wt. % moisture following the adjustment in this step;

adjusting moisture content in a traveling first web of liner material so that said first web of liner material comprises 6-9 wt. % moisture following the adjustment in this step;

adjusting moisture content in a traveling second web of liner material so that said second web of liner material comprises 6-9 wt. % moisture following the adjustment in this step;

wherein adjusting the moisture in each of said webs is performed by applying a respective substantially continuous thin film comprising both water and adhesive to each of said webs;

following the respective moisture-adjustment step for each of said webs, heating each of said web of medium material and said first and second webs of liner material to a temperature less than or equal to about 100° C., such that each said web retains 6-9 wt. % liquid moisture therein after heating as a result of the respective moisture-adjustment step for each of said webs;

after the heating of said web of medium material, corrugating said web of medium material to produce a corrugated web, wherein a surface of said medium material on which the respective thin film was applied remains exposed during said corrugating;

adhering said first web of liner material, after said heating thereof, to said corrugated web; and adhering said second web of liner material, after said heating thereof, to said corrugated web, opposite said first web of liner material, to produce a double-faced web, wherein said corrugated web is in contact with both of said first and second webs of liner material.

34. A method of claim 33, said thin films each comprising a high-solids content adhesive that comprises at least 25 wt. % solids.

35. A method of claim 34, said high-solids content adhesive comprising at least 40 wt. % solids.

36. A method of claim 33, comprising adhering each of said first and second webs of liner material to said corrugated web via said adhesive in said respective thin films comprising water and adhesive applied thereon, without a separate application of adhesive to flute crests on said corrugated web.

* * * * *